US008931383B1

(12) United States Patent
Hurwicz

(10) Patent No.: US 8,931,383 B1
(45) Date of Patent: Jan. 13, 2015

(54) TOOL AND METHOD FOR OPENING BLISTERS ON A BLISTER PACK

(76) Inventor: Maxim Hurwicz, Stanchfield, MN (US)

( * ) Notice: Subject to any disclaimer, the term of this patent is extended or adjusted under 35 U.S.C. 154(b) by 211 days.

(21) Appl. No.: 13/495,026

(22) Filed: Jun. 13, 2012

Related U.S. Application Data

(60) Provisional application No. 61/496,308, filed on Jun. 13, 2011.

(51) Int. Cl.
*B26B 27/00* (2006.01)
*B26D 3/00* (2006.01)

(52) U.S. Cl.
USPC ..... 83/56; 30/90.4

(58) Field of Classification Search
CPC ..... A61M 25/0668; H02G 1/1229; H02G 1/1217; H02G 1/126; B65D 2575/3227; B65D 2575/3218
USPC ..... 83/52–56; 30/90.1–90.8; 414/412
See application file for complete search history.

(56) References Cited

U.S. PATENT DOCUMENTS 2,018,149 A * 10/1935 Randle et al. ..... 30/2
2,731,970 A * 1/1956 Hughes ..... 30/120.1
2,819,520 A * 1/1958 Eyles ..... 30/90.8
3,092,906 A * 6/1963 Deering ..... 30/90.6
3,619,902 A * 11/1971 Fleury ..... 30/294
4,489,491 A * 12/1984 Gregson ..... 30/90.7
4,530,154 A * 7/1985 DiCarlo ..... 30/294
4,884,339 A * 12/1989 Custin ..... 30/90.4
4,972,581 A * 11/1990 McCollum et al. ..... 30/90.1
4,997,424 A * 3/1991 Little ..... 604/161
5,330,460 A * 7/1994 Moss et al. ..... 30/90.4
5,332,096 A * 7/1994 Battaglia ..... 206/532
5,443,536 A * 8/1995 Kiritsy et al. ..... 30/90.8
5,791,048 A * 8/1998 Bodnar et al. ..... 30/2
5,815,930 A * 10/1998 Kojima ..... 30/294
6,581,291 B1 * 6/2003 Tarpill et al. ..... 30/90.4
6,612,036 B2 * 9/2003 Frazier ..... 30/293
6,625,889 B2 * 9/2003 Belsaas ..... 30/280
7,752,758 B2 * 7/2010 Gelardi ..... 30/124
7,891,097 B2 * 2/2011 Hartranft ..... 30/90.3
7,891,100 B2 * 2/2011 Gelardi et al. ..... 30/294
2007/0234858 A1 * 10/2007 Sullivan et al. ..... 83/13

* cited by examiner

*Primary Examiner* — Ghassem Alie
*Assistant Examiner* — Bharat C Patel
(74) *Attorney, Agent, or Firm* — Sherrill Law Offices, PLLC

(57) ABSTRACT

A manually operable tool and method of using the tool to open blisters on a blister pack. The tool includes a body defining a laterally extending guideway of b-shaped cross-section, and a sharp with a laterally extending cutting edge which extends transversely into the guideway from a sidewall without contacting the opposite sidewall, thereby leaving a transverse gap between the sharp and the second sidewall. The method involves the step of laterally sliding a laterally aligned blister pack through the guideway and out through the second end, whereby the cutting edge contacts and cuts through an end of the blisters slid past the cutting edge without cutting completely through the blister pack.

7 Claims, 19 Drawing Sheets

Figure 9a
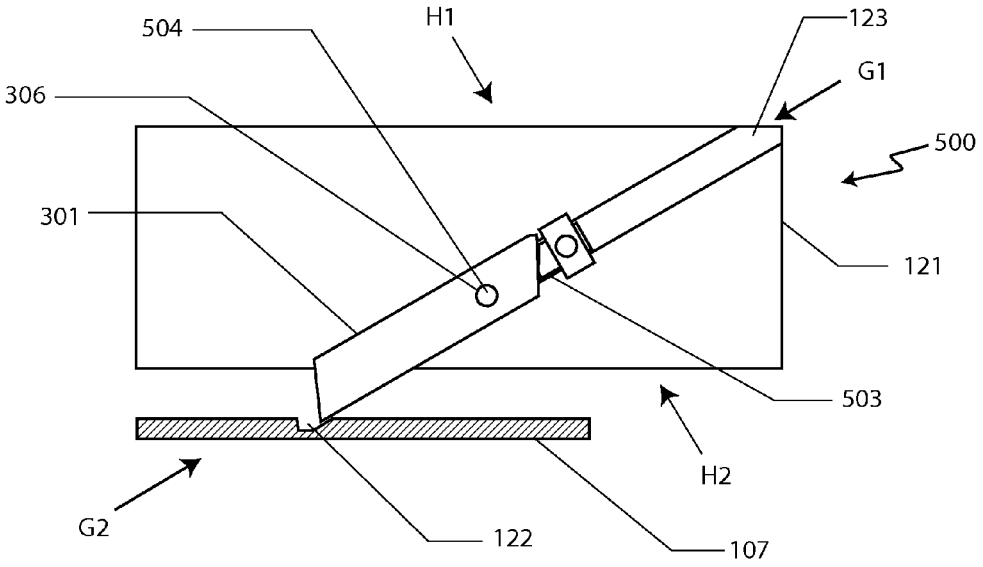
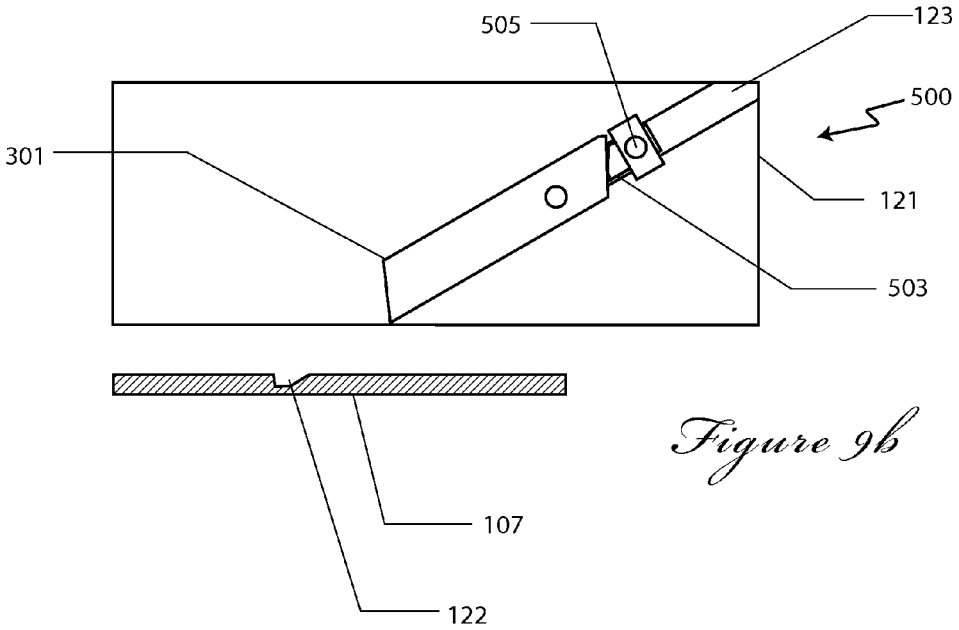
Figure 9b

TOOL AND METHOD FOR OPENING BLISTERS ON A BLISTER PACK

This application claims the benefit of U.S. Provisional Application No. 61/496,308, filed Jun. 13, 2011.

BACKGROUND

Blister packs are good for storage, transport and preservation of their contents. But they can be inconvenient when it comes time to dispense their contents, especially with blister packs that have multiple layered seals. A problem can arise when a complex or tough seal requires more dexterity or strength or attention than the user has available. Another problem is that after one has removed the contents, one cannot replace them securely in the blister pack.

Blister packs with nicotine gum are different from the soft-pack blister packages which typically contain medications such as pills or tablets. Such soft-packs usually have a clear, partially raised plastic blister layer and a "soft", thin foil base sealing the medication within the blisters. The user can break through the foil to remove medication, either by piercing the foil side and picking out the contents or by pressing on the plastic blister and thus forcing the pill to break through the foil. Prior art describes many devices for assisting the user in either or both of these actions.

Unfortunately, some blister packs, such as those with nicotine gum, do not simply have only a soft foil sealing layer but instead a thicker layer sealing the contents within. For instance, with a nicotine gum blister flat, there is a soft foil metal layer against the clear plastic blister layer and then another layer of paper and/or plastic backing over the foil. The blister layer usually consists of a clear PVC/PVDC film. These layers are laminated together in various ways. This type of backing (instead of just a foil layer) is appreciably tougher which makes it harder or even impossible for the user to perform the usual methods of poking through the backing to access the contents or pressing on the blister to push the contents out through the backing.

To manually remove a single piece of gum with traditional methods, one is required to first separate an individual blister unit (tear it off from the flat along perforations). Then one must look to find a tiny arrow printed on one corner on the back. Then one picks at that corner of the sealing paper to curl it up. Grasping the tiny curled corner, which stands only about an eighth of an inch high, one tugs to peel away the outer layer to reveal the foil layer below. Sometimes part or all of the foil sticks to the paper and is torn off. If not, then one must pierce the foil to remove the gum or press on the blister to force the gum through the foil. Of course, nicotine gum is intended for people who are trying to quit smoking, so when they are going through all of these steps they may well be in the midst of withdrawal symptoms such as irritability, impatience, crankiness, and have a diminished ability to concentrate. Additionally, if someone is watching while the user is trying to open the blister pack, the frustrated user can become an object of pity or ridicule. This can be a safety issue if the user is distracted by trying to open a blister unit while driving. Users with hand weaknesses or deformities have a hard time opening blister packages which just have a foil layer, so any help with opening reinforced or even simple foil blister seals would be welcomed.

Many devices have been designed to cut through wrappings to gain access to contents. Although they vary in appearance and operation, they all are intended for immediate dispensing of contents and all require one have the wrapped package and tool at the same time. Further, they all require one's attention be devoted to engaging the tool with the package to be opened while dispensing the contents. It also means that the package in question is either sealed closed so the contents cannot fall out or cut open after which the contents can fall out.

Blister packs make for a convenient, portable storage container, but much of that convenience is lost if one must also carry around an opener.

What would be better is if the blister pack itself were transformed to make it easier and more convenient to dispense its contents. And if the package could be opened and reclosed as desired.

Looking at devices such as U.S. Pat. No. 2,238,753 Package Opener one sees essentially a blade in a folding handle. U.S. Pat. No. 7,730,620 Plastic Package Opener is a blade in a springy handle. 2009/0235537 Blister Package Opener is basically a motorized version of these inventions intended to cut off the sealed edges of a package. All allow the user to cut through a package but none allows the user to easily and controllably vary the depth of the cut to make a reclosable package. They are all intended for immediate dispensing of the contents of the wrapped container. They all are intended to have the package and opener at hand to immediately dispense the contents of the package.

Devices such as U.S. Pat. No. 5,666,731 Opening Device for Plastic Packages, D419,417 Compact Disc Case Wrapper Opener, U.S. Pat. No. 4,001,934 Coin Roll Cutter, and U.S. Pat. No. 6,615,495 Apparatus and Method for Perforating Package Coverings are all similar devices for cutting through the top layer of wrapping of a package such as the shrink wrap on a DVD case. None are capable of creating a reclosable package, instead they are designed to make a cut through a thin top layer of wrapping without cutting the inner package. The inner package is the "contents" which is immediately "dispensed".

Devices such as U.S. Pat. No. 4,711,031 Envelope Opener, U.S. Pat. No. 4,530,154 Slitter Assembly, U.S. Pat. No. 5,127,161 Cutter are all designed to open envelopes by means of running an envelope through a slot where a blade perpendicular to the envelope cuts through one or more thicknesses of paper. They all function to cut through a thin layer of a relatively flat package after which, for all intents and purposes, the envelope is open along one edge. If this were a blister pack the contents would be free to spill out.

Devices such as U.S. Pat. No. 4,975,015 Blister Package Opening Method and Apparatus and U.S. Pat. No. 7,866,049 Universal Blister Pack Opener both open blisters by cutting through the raised blister layer in a plane parallel to and next to the foil sealing layer. Both are intended for immediately dispensing the blister's contents. Also, to liberate the contents the raised blister must be cut through almost completely, leaving only a small portion of the blister as a hinge. Such a door can open inadvertently at any time, possibly spilling the contents and thus is not conveniently portable. Both require the user to have the tool at hand when opening a blister in order to dispense the contents.

Devices such as U.S. Pat. No. 5,472,115 Blisterpack Opening Tool and U.S. Pat. No. 5,791,513 Medication Dispensing Aid dispense the contents of a blisterpack by pressing on the raised blister layer to force the contents through the foil sealing layer. This type of device is intended to dispense items for immediate use and requires one to have the tool handy when doing so and does not create a reclosable package.

So a quick, easy, inconspicuous method is needed to open one or more blisters, and to selectively dispense and dispose of the contents after the blisters are opened. Additionally such a method should also be relatively childproof (as the existing double seal is relatively childproof) without frustrating the adult user. Also, it would be nice, if the user changes their mind, if it were possible to replace removed contents securely back into the blister.

SUMMARY OF THE INVENTION

A first aspect of the invention is a manually operable tool for opening blisters on a blister pack.

A first embodiment of the tool includes a body defining a laterally extending guideway, a hand graspable tab extending from the body and a sharp within the guideway. The guideway has (i) a lateral length with first and second open lateral ends, (ii) a transverse width defined by first and second sidewalls with the first sidewall spaced in a first transverse direction from the second sidewall, and (iii) a first surface interconnecting the first and second sidewalls and having a stepped configuration so as to delineate a wide primary channel of the guideway and a narrow secondary channel of the guideway with the secondary channel extending along the intersection of the first surface and the second sidewall. The hand graspable tab is attached to the body and extends in the first transverse direction away from the guideway. The sharp is secured to the body and has a laterally extending and laterally canted cutting edge extending transversely into the primary channel of the guideway from the first sidewall a transverse distance insufficient to contact the second sidewall so as to leave a transverse gap between the sharp and the second sidewall.

A second embodiment of the tool includes a body defining a laterally extending guideway of b-shaped cross-section, a slot through the body in communications with the guideway, a hand graspable tab extending from the body and a sharp within the guideway. The guideway has (i) a lateral length with first and second open lateral ends, (ii) a longitudinal height defined by first and second surfaces, and (iii) a transverse width defined by first and second sidewalls with the first sidewall spaced in a first transverse direction from the second sidewall. The first surface has a stepped configuration so as to delineate a wide primary channel of the guideway and a narrow secondary channel of the guideway with the secondary channel extending along the intersection of the first surface and the second sidewall. The slot extends the full lateral length of the guideway proximate the intersection of the second surface and the second sidewall. The hand graspable tab is attached to the body and extends in the first transverse direction away from the guideway. The sharp is secured to the body and has a laterally extending and laterally canted cutting edge extending transversely into the primary channel of the guideway from the first sidewall a transverse distance insufficient to contact the second sidewall so as to leave a transverse gap between the sharp and the second sidewall.

In a preferred embodiment (i) the primary channel of the guideway is configured and arranged to accommodate and guide insertion and sliding of a row of blisters on a blister pack along the lateral length of the primary channel from the first end of the guideway towards the second end of the guideway and into cutting engagement with and past the cutting edge of the sharp, whereby the cutting edge is operable for cutting through blisters slid past the cutting edge proximate an end of each blister without cutting completely through the blister pack, and (ii) the secondary channel of the guideway is configured and arranged to accommodate insertion and sliding of a low profile margin extending from a row of blisters inserted into and slid along the primary channel.

A second aspect of the invention is a method of opening blisters on a blister pack.

A first embodiment of the method includes the steps of (a) obtaining a tool according to the first embodiment of the first aspect of the invention, (b) obtaining a blister pack having at least one row of blisters with content and a low profile margin extending alongside the row of blisters, (c) aligning the blister pack with the guideway at the first end of the guideway, with the row of blisters laterally aligned with the primary channel, and the margin laterally aligned with the secondary channel, and (d) laterally sliding the aligned blister pack through the passageway and out through the second end, whereby the cutting edge cuts through an end of the blisters slid past the cutting edge without cutting completely through the blister pack so as to form a live hinge on the blister pack which is operable for providing access to the contents of the cut blister when actuated.

A second embodiment of the method includes the steps of (a) obtaining a tool according to the second embodiment of the first aspect of the invention, (b) obtaining a blister pack having at least one row of blisters with content and low profile margins extending alongside opposed sides of the row of blisters, (c) aligning the blister pack with the guideway at the first end of the guideway, with the row of blisters laterally aligned with the primary channel, one of the margins laterally aligned with the secondary channel, and the other margin laterally aligned with the slot, and (d) laterally sliding the aligned blister pack through the passageway and out through the second end, whereby the cutting edge cuts through an end of the blisters slid past the cutting edge without cutting completely through the blister pack so as to form a live hinge on the blister pack which is operable for providing access to the contents of the cut blister when actuated.

BRIEF DESCRIPTION OF THE DRAWINGS

FIG. 9*a* is a top view of the advance/withdraw mechanism on the invention depicted in FIG. 1 in the blade advanced position.

FIG. 9*b* is a top view of the advance/withdraw mechanism on the invention depicted in FIG. 1 in the blade withdrawn position.

DETAILED DESCRIPTION OF A PREFERRED EMBODIMENT

Nomenclature

Figure 1:
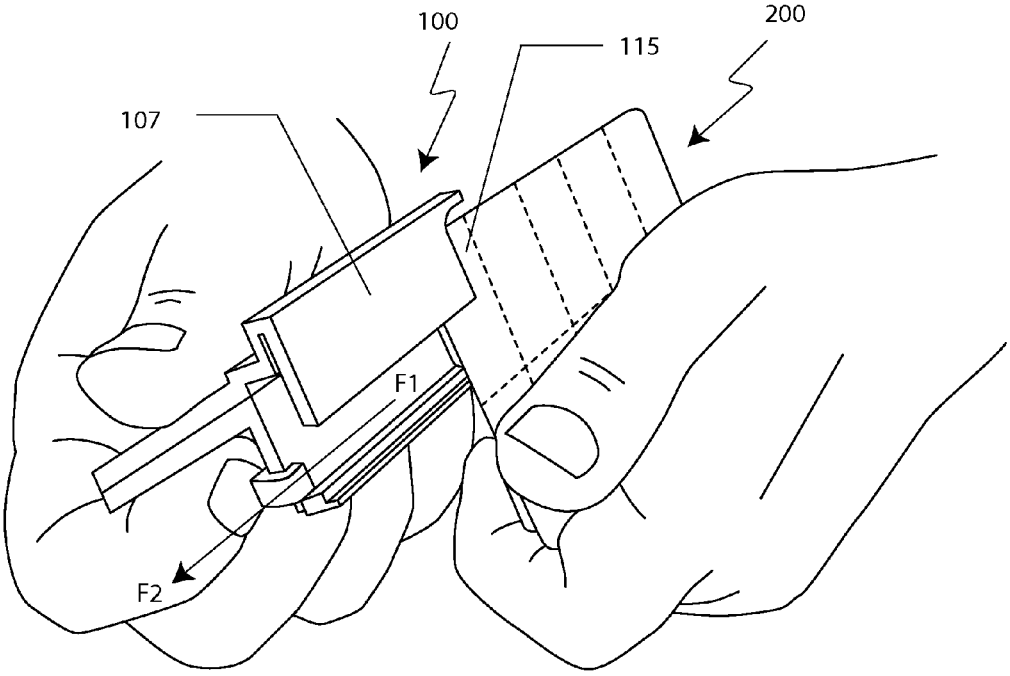
FIG. 1 is a perspective view of one embodiment of the invention being used to open a blister pack.

100 Tool Including Blade
101 First Guide or First Sidewall
102 Second Guide of First Surface
103 Third Guide (one surface of blade guard) or Second Sidewall
104 Fourth Guide or Second Surface
105 Fifth Guide
106 Sixth Guide
107 Blade Guard
108 Recess for Margin (major margin) or Secondary Channel of Guideway
109 Uncut Portion (of blister unit) (used when referring to the cutting depth)
110 Recess for Razor Blade
111 Channel
112 Shelf (which includes guides 104 and 106)
113 Snap Fit Recesses (goes with 401)
114 Protrusion (s)/Energy Director(s)
115 Notch Cut Out of Third Guide
116 Top Blade Retainer
117 Bottom Retainer
118 Living Hinge
119 Screws
120 Upper Half (of opener)
121 Lower Half (of opener)
122 Recess in Guard for Blade
123 Channel for Sled and Blade or Primary Channel of Guideway
124 Orifices for Accepting Screws
130 Guideway
131 First End of Guideway
132 Second End of Guideway
140 Slot
200 Blister Pack (as a unit including gum) (also called a flat)
201 Rounded Edge of Blister
202 Sealing Foil
203 Structural Backing
204 Gum
205 Major Gutter
206 Major Margin
207 Rounded Edge of Gum
208 Void
209 Individual Blister or Blister Unit
210 Minor Gutter
211 Minor Margin
212 Smooth lip
213 Hooked Lip
214 Hinge (which accompanies smooth lip 212)
215 Hinge (which accompanies hooked lip 213)
216 Door
217 Clear Partially Raised Blister Plastic Layer
218 Perforations
219 Blister Sides
220 Margin Cut
300 Razor (blade and guard as a unit)
301 Blade (separate from Blade Guard 303) or Sharp
302 Cutting Edge (of razor blade or sharp)
303 Blade Guard (back of Razor 300)
304 Tilt Angle of Blade (0° to 12° with existing blister packs of nicotine gum)
305 Attack Angle of Blade (10° to 70° with a single-edge razor blade)
306 Hole in Retractable Blade
307 Holes/Notches in Single-Edged Blade
400 Adapter
401 Cantilever Snap Hooks (goes with 113)
402 Spacers
403 First Edge (of adapter)
404 Second Edge (of adapter)
500 Mechanism (advance/withdraw blade)
501 Knob
502 Washer
503 Sled
504 Bump in Sled to Hole Blade

Figure 2A:
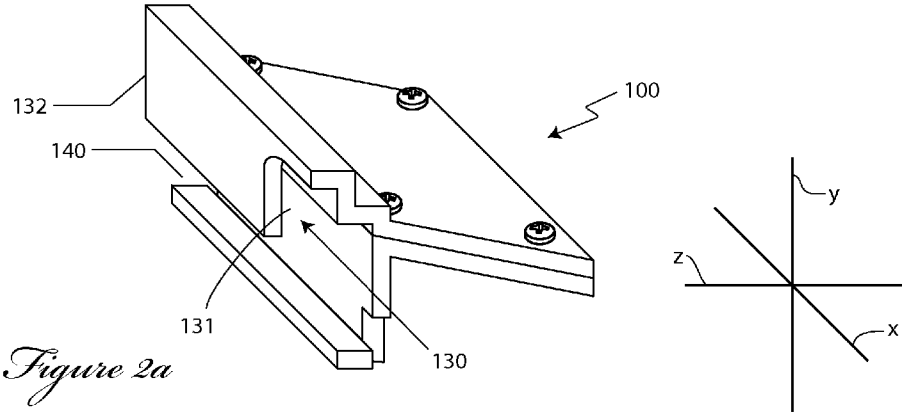
FIG. 2*a* is a perspective view of the invention depicted in FIG. 1.
Figure 2B:
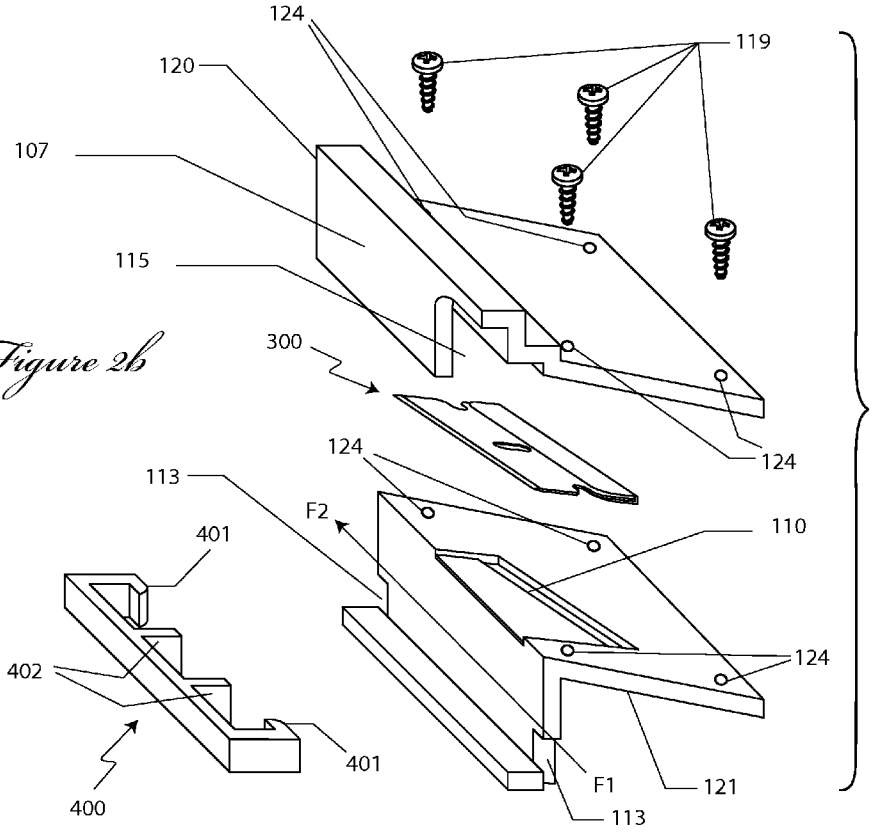
FIG. 2*b* is an exploded perspective view of invention depicted in FIG. 1 including an adapter.
Figure 3:
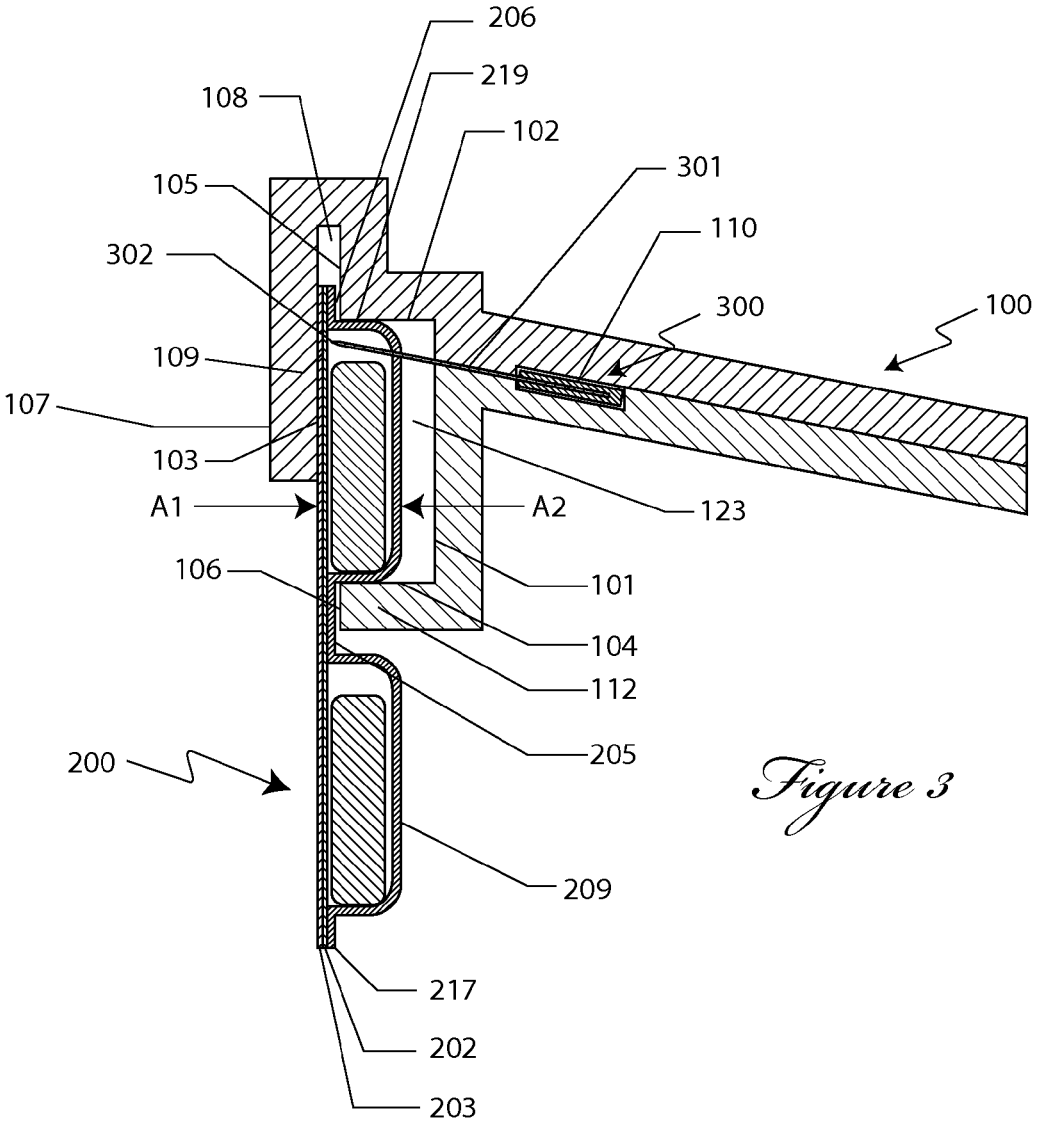
FIG. 3 is a cross-sectional side view of invention depicted in FIG. 1 being used to open a blister pack.
Figure 5:
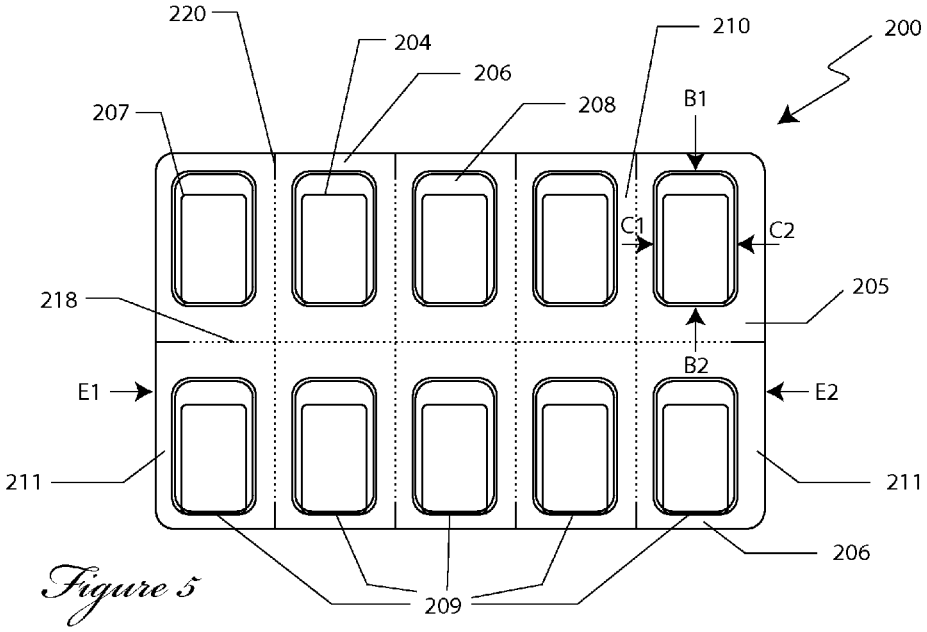
FIG. 5 is a front view of a conventional blister pack.
Figure 9C:
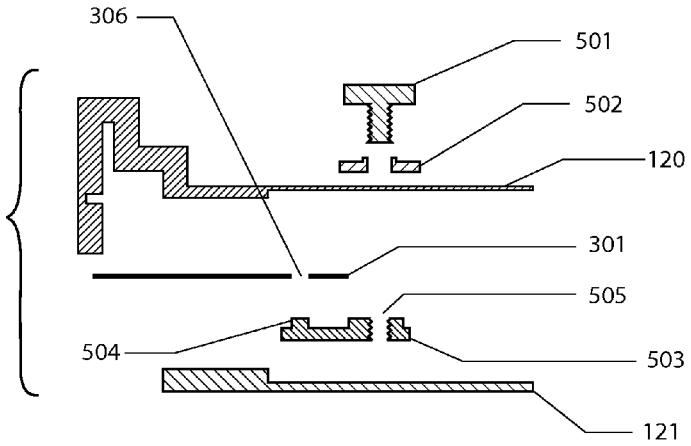
FIG. 9*c* is an exploded cutaway view of the advance/withdraw mechanism depicted in FIG. 9*a* taken along line G1-G2.
Figure 9D:
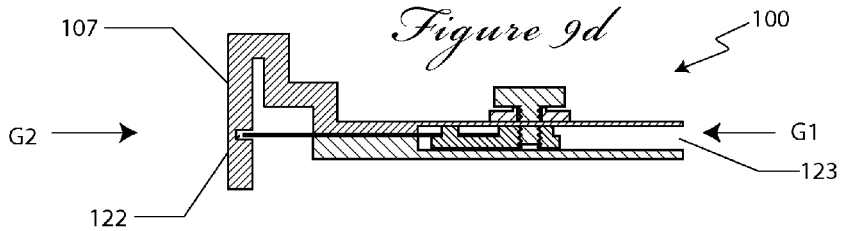
FIG. 9*d* is an assembled view of the advance/withdraw mechanism depicted in FIG. 9*c*.
Figure 9E:
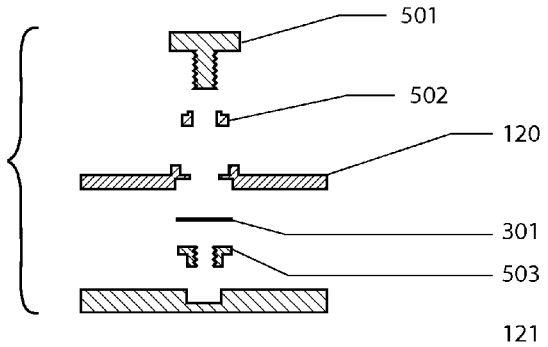
FIG. 9*e* is an exploded cutaway view of the advance/withdraw mechanism depicted in FIG. 9*a* taken along line H1-H2.
Figure 9F:
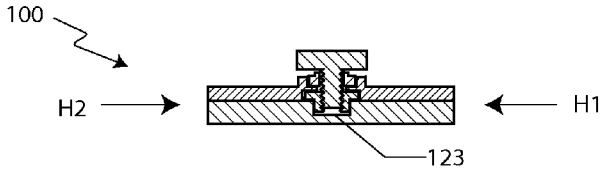
FIG. 9*f* is an assembled view of the advance/withdraw mechanism depicted in FIG. 9*e*.
Figure 15:
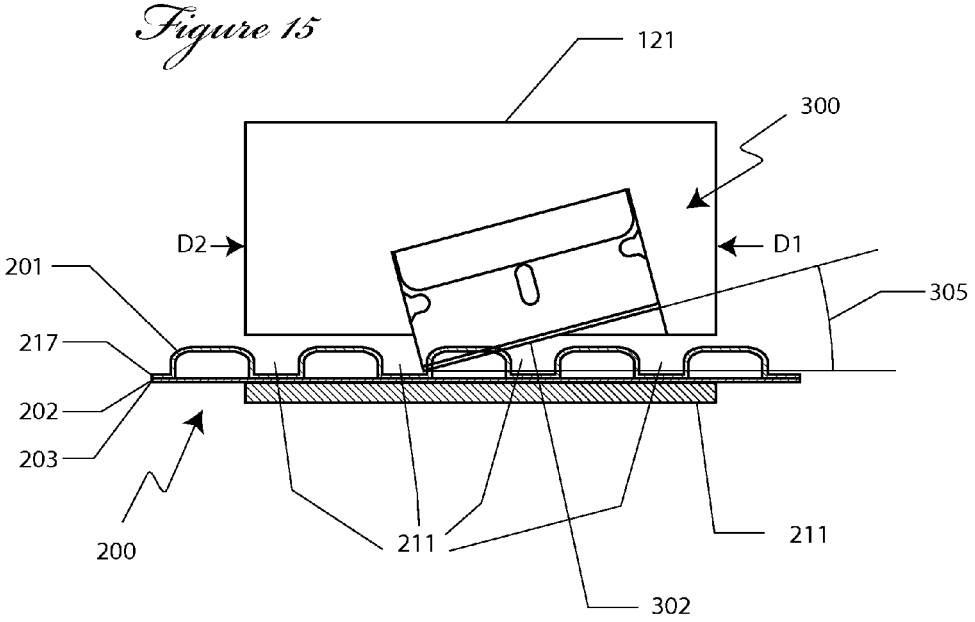
FIG. 15 is a cutaway top view of the lower portion of the invention depicted in FIG. 13 showing the attack angle of the sharp opening a blister pack.
Figure 20A:
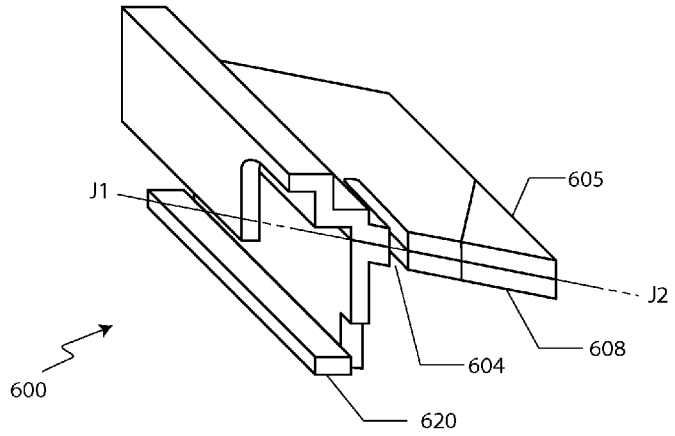
FIG. 20*a* is a perspective view of another embodiment of the invention with a hinged cap.
Figure 21A:
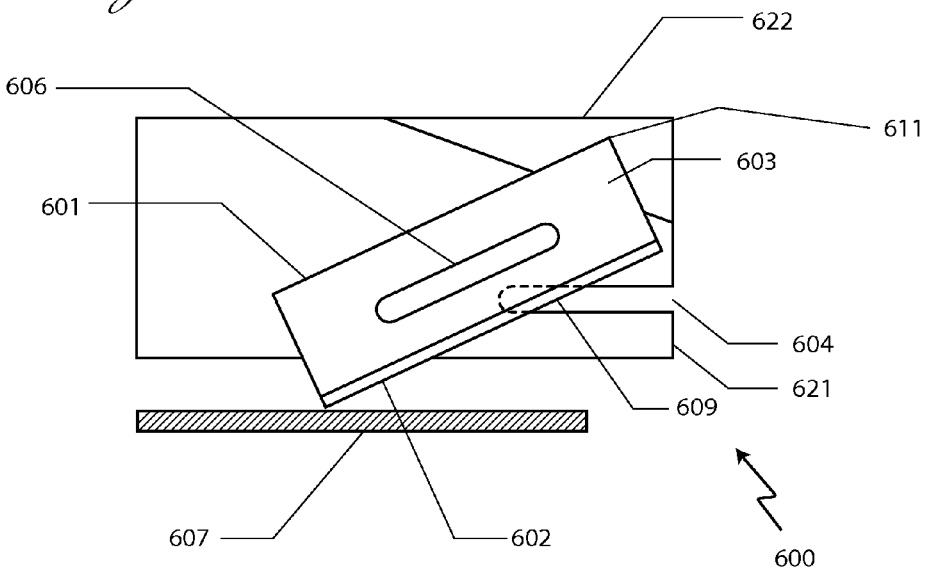
FIG. 21*a* is a top view of the invention depicted in FIG. 20*a* taken along line J1-J2 with blade and modified with a detachable cap.

505 Threaded Hole in Sled
600 Multi-Functional Tool
601 Blade
602 Cutting Edge of Blade
603 Recess in Cap for Exposed Portion of Blade
604 Slot
605 Top Hinged Cap
606 Hole in Blade
607 Guard
608 Bottom of Hinged Cap
609 Exposed Portion of Blade
610 Recess for Blade
611 Exposed Corner of Blade
613 Snap Fit Recesses
614 Protrusion
620 Top Portion of Opener
621 Bottom Portion of Opener
622 Detachable Cap
x Lateral
y Longitude
z Transverse
A1-A2 Depth of blister as shown in FIG. 3 (backing plus foil plus raised blister unit)
B1-B2 Width of blister as shown in FIG. 5
C1-C2 Length of individual blister as shown in FIG. 5
D1-D2 Length of tool 100 as shown in FIG. 15
E1-E2 Length of the flat 200 as shown in FIG. 5
F1-F2 Path of blisters going through the device as shown in FIG. 2
G1-G2 Cross-section of advance/withdraw mechanism for FIGS. 9*c* and 9*d*
H1-H2 Cross-section of advance/withdraw mechanism for FIGS. 9*e* and 9*f*
J1-J2 Cross-section of Multi-Functional Tool 600 as shown in FIG. 21*a* for FIGS. 20*ac* and 20*b*

Construction

Figure 4:
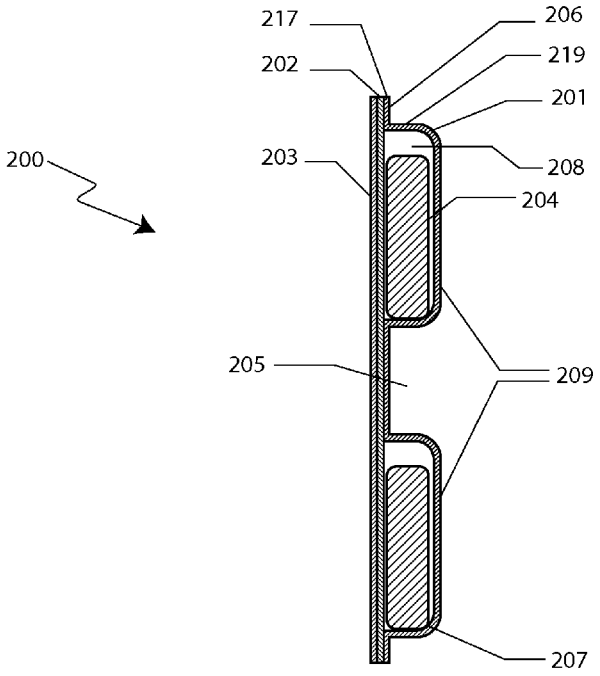
FIG. 4 is a cross-sectional side view of a conventional blister pack.

The present invention is directed to a blister opener tool 100, as shown in FIG. 1, particularly, as shown in FIG. 4, with blister packs 200 with individual blisters 209, and more particularly with blisters 209 containing nicotine gum 204.

As shown in FIG. 5, with blister packs 200 of nicotine gum 204 the individual blister units 209 usually rise in parallel rows of five blister units 209 (for a total of ten blister units 209) which creates a major gutter 205. There are also spaces between the blister units 209 which run perpendicular to the major gutter 205 to form four minor gutters 210, each such minor gutter 210 being two blister units 209 long. The flat 200 extends beyond the blister units 209 on all four sides to create two major margins 206 and two minor margins 211. Although this disclosure focuses on blister units 209 containing nicotine gum 204, it will be understood that the same invention with some modifications obvious to those skilled in the art would work for blister packs 200 with other sorts of contents. In fact, the disclosure of the present invention describes many design criteria and directions which will assist anyone to tailor a blister opener tool 100 to their particular needs. Further, although the disclosure of the present invention focuses on blister packs 200 with multiple layer seals, it works with a seal of a single layer or any seal with layers which can be bent manually. In other words, an example of a solution to the problem of opening one of the tougher known blisters is shown in order to exemplify its capabilities.

When the user is done chewing the gum 204, they need to find somewhere to dispose of it, which is not always handy.

Figure 8:
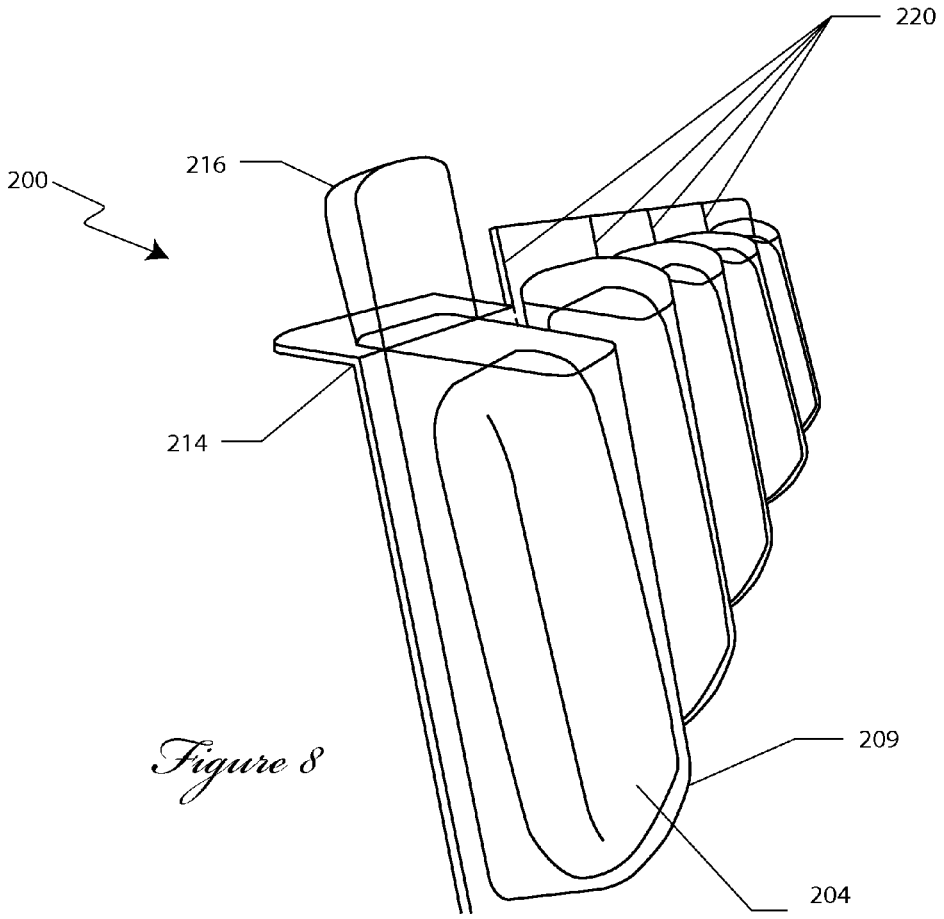
FIG. 8 is a perspective view of a portion of the blister pack depicted in FIG. 6*b*.

As shown in FIG. 3, one embodiment of the present invention is a tool 100 which takes a new approach by cutting through blister units 209 in a direction generally perpendicular to the plane of sealing foil 202. Cutting from the blister side, as opposed to cutting or entering the blister units 209 through foil side, results in the creation of "doors" 216, as shown in FIG. 8, which realizes all the previously mentioned desired goals and other advantages as mentioned elsewhere in this disclosure.

A preferred embodiment of the present invention 100, shown in FIG. 1, can cut one or more blisters units 209 in a single motion. Referring to FIGS. 1, 2 and 3, the tool 100 has a body that defines a laterally x extending guideway 130 having (i) a lateral x length with first 131 and second 132 open lateral x ends, (ii) a transverse z width defined by first 101 and second 103 sidewalls with the first sidewall 101 spaced in a first transverse z direction from the second sidewall 103, and (iii) a first surface 102 interconnecting the first 101 and second 103 sidewalls and having a stepped configuration so as to delineate a wide primary channel 123 of the guideway 130 and a narrow secondary channel 108 of the guideway 130, wherein wide indicates wider than the narrow channel and narrow indicates narrower than the wide channel, with the secondary channel 108 extending along the intersection of the first surface 102 and the second sidewall 103. A laterally x extending slot 140 extends the entire length x of the guideway 130 proximate the intersection of a second surface 104 and the second sidewall 103. The user holds the tool 100 in one hand and holds the flat 200 by one row of blister units 209 with the other hand. The user then inserts the leading blister units 209 of the un-held row of blister units 209 into notch 115 and slides the flat 200 directionally along line F1-F2 towards razor blade 300, which can be seen in exploded FIG. 2*b*. By either pushing the flat 200 through the device, and/or pulling the tool 100 over the flat 200, one row of blister units 209 are cut. So if a blister pack 200 has, for instance, five blister units 209 in each of two rows, the user can cut an entire row of five blister units 209 in one motion. Then the user can rotate the flat 200 to run the other, uncut row of blister units 209 through to cut them. While easy for an adult, this procedure requires a level of dexterity and strength which results in it being relatively childproof. The user can then drop the flat 200 in his pocket for later use or, as shown in FIG. 8, can immediately open a door 216 of a blister unit 209 along hinge 214 and remove a piece of gum 204. Later on he can re-open a door 216 to an empty blister unit 209, place his used gum 204 in it, close the door 216 and safely replace it in his pocket without fear of the gum 204 getting on his clothing. Unused gum 204 can be replaced in an empty blister unit 209 as well. If desired, the user can open and close one or more doors 216 at a time. This can be done quickly, easily and inconspicuously. Opening and dispensing a piece of gum 204 can even be done one-handed, which would be inconspicuous when in public, and safer when driving as one could keep one hand on the steering wheel and both eyes on the road.

Figure 6A:
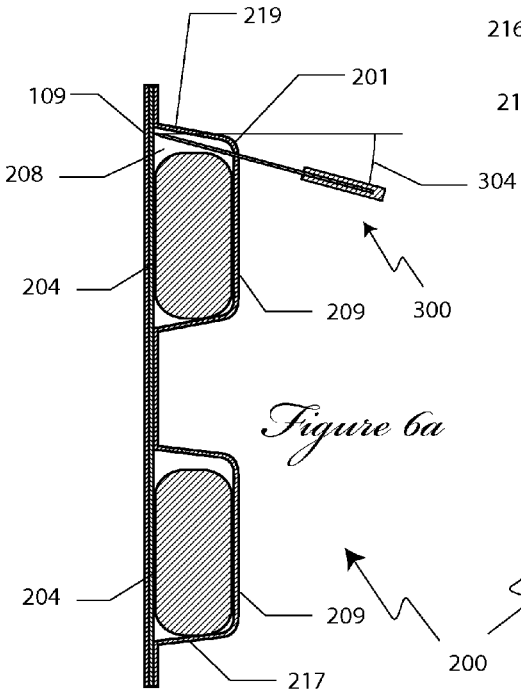
FIG. 6*a* is a side view of the sharp portion of the invention depicted in FIG. 1 cutting into a blister pack at an oblique angle.
Figure 6B:
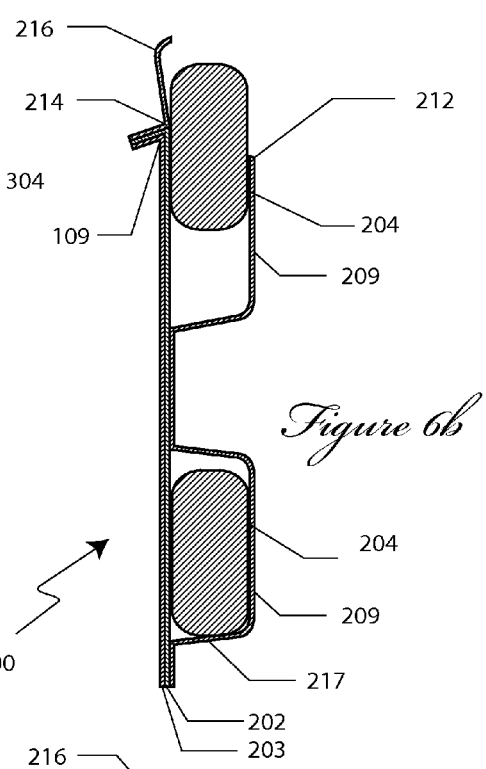
FIG. 6*b* is a side view of the blister pack depicted in FIG. 6*a* after being cut by the sharp portion of the invention with one of the blisters bent open and the product partially removed.

A preferred embodiment of the present invention can either cut through both the blister units 209 and the sealing foil 202 (and other backing materials) or only cut through part of the blister units 209 or any intermediate amount. By cutting completely through both the blister units 209 and the sealing foil 202, the contents can be easily removed. As shown in FIG. 6*a*, by cutting less than all the way through the blister units 209, sealing foil 202 and plastic/paper structural backing 203, any uncut material provides support to hold the divided blister parts together. As shown in FIG. 6*b*, this creates a door 216 which can be folded back while the uncut portion of the blister unit 109 acts as a hinge 214. As one opens said door 216, any uncut part 109 of the raised plastic blister unit 209 tends to continue to rip along the fissure towards the sealing foil 202, so cutting the blister unit 209 down to the sealing foil 202 is not necessarily required, although scoring the portion of the blister layer 217 in contact with the sealing foil 202 makes for a neater fold along the hinge 214. The sealing foil 202 and plastic/paper structural backing 203 tends to hold the blister units 209 open or shut as the user desires. Additionally, when the user wants to discard used gum 204 or replace unused gum 204, they can open a door 216 to an empty blister unit 209, deposit the gum 204 and close the door 216.

It is easier to cut through only the blister unit 209 as opposed to cutting through both the blister unit 209 and the gum 204 contained therein. This is facilitated by the user holding the tool 100 and inserting a flat 200 in such a way that the gum 204 falls away from the blade 300 due to gravity as shown in FIG. 3.

As shown in FIG. 5, flats 200 usually have perforations 218 and sometimes a margin cut 220 through sealing foil 202 and structural backing 203 and the blister units 209. As shown in FIG. 8, after one has cut the blister units 209, the margin cuts 220 and perforations 218 make it easier to open a single door 216.

Figure 18A:
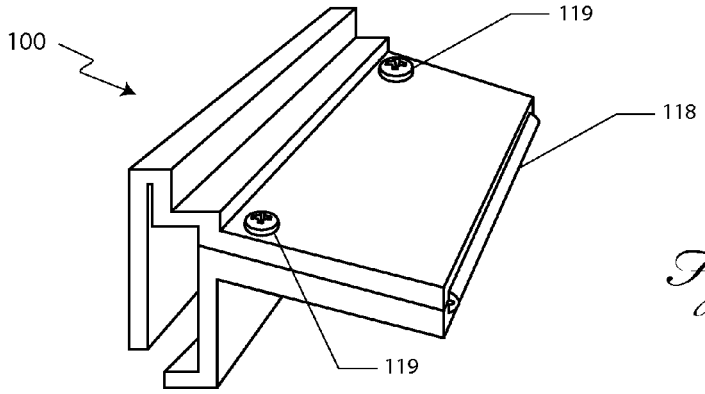
FIG. 18*a* is a perspective view of another embodiment of the invention equipped with a living hinge.
Figure 18B:
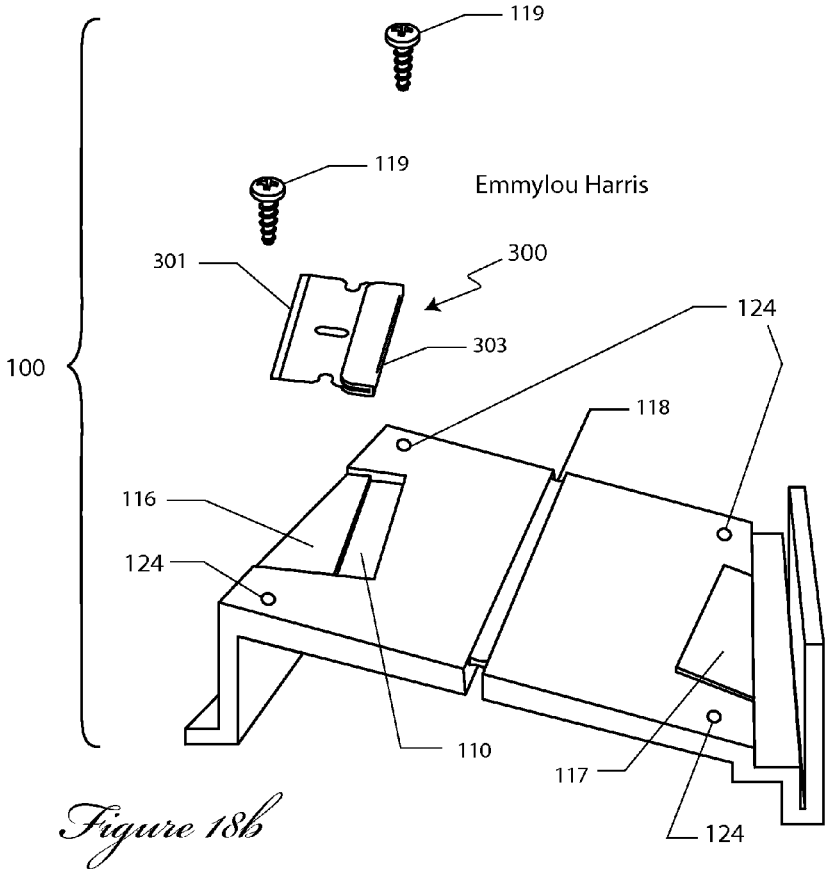
FIG. 18*b* is an exploded perspective view of the invention depicted in FIG. 18*a*.

The preferred embodiment shows the tool 100 in FIGS. 2*a* and 2*b* having an upper half 120 and a lower half 121 (plus the razor blade 300 and adapter 400), to be joined together, but other approaches can be utilized such as these two halves 120 and 121 could be a single hinged unit as shown in FIGS. 18*a* and 18*b* or the entire unit can be produced as a single molded piece with the cutting blade 300 molded in (not shown). Joining the hinged or separate pieces can be accomplished by screws 119 and corresponding orifices 124 or other means including adhesives, welding, rivets or snap fits. With some methods closure is permanent and with others the device can be opened and the blade 300 can be replaced (or flipped to present a new edge) and the device re-closed.

There are many known mechanisms for having a blade 301 which can be extended and withdrawn which could be incorporated in the present invention. FIGS. 9*a* through 9*f* show an example of such a mechanism 500. It is similar to a widely employed mechanism used in utility knives sold in stores. For clarity, in FIGS. 9*a* and 9*b* the upper half 120, knob 501 and washer 502 are not shown. FIG. 9*a* shows the blade 300 extended and FIG. 9*b* shows the blade 300 withdrawn. Optional recess 122 in the blade guard 107 allows the blade 300 to cut past the sealing layers. Referring to 9*c* and 9*d* the upper half 120 and lower half 121 of the body comprise a channel 123 into which is inserted a sled 503 shaped to receive blade 301 which has hole 306. Hole 306 goes over bump 504 in the sled 503. Knob 501 goes through washer 502 and threads into threaded hole 505 in said sled 503. Tightening the knob 501 holds the sled 503 and blade 301 securely in place. Loosening said knob 501 allows the user to advance or withdraw the blade 301 as desired. Moving the blade 301 towards and away from the blade guard 107 along line G1-G2 enables the user to control the depth of cut. This is just one of many such mechanisms that could be incorporated into the tool 100 of this disclosure. These and other such variations can be utilized without departing from the scope of the present invention.

FIG. 18*a* shows one embodiment of the tool 100 with a living hinge 118 in the closed position. FIG. 18*b* shows the same tool 100 with a living hinge 118 and a razor blade 300 in the open position. Razor blade 300 is comprised of blade 301 and back 303. Razor blades 300 without a back 303 can be used, if desired (not shown). Recess 110 is shaped to receive razor blade 300. The back 303 fits into a deeper portion of the recess 110 and the blade 300 is held securely between top blade retainer 116 and bottom blade retainer 117. The recess 110 and blade retainers 116 and 117 assist in holding the blade 300 in the desired position and orientation. Means for holding the folded halves shut are not shown.

FIG. 3 shows a first guide 101 which cooperates with a second guide 102 to regulate where the cut divides the blister unit 209 in two.

Blade guard 107 prevents accidental contact with the blade 300 and supplies a third guide 103 which regulates the depth of the cut. The optional notch 115 (as shown in FIG. 1) in the blade guard 107 also serves as a guide for initially inserting a blister unit 209 into the tool 100.

Although each of the blister units 209 in a flat of blisters 200 tend to be more or less identical dimensionally, from one brand or type of blister pack 200 to another one encounters appreciable variations such as the size of the blister pocket, angles of blister walls, gutter and margin widths, gum dimensions, and foil/plastic/paper backing and blister plastic thickness.

As shown in FIG. 3, the varying widths of blister major margins 206 are accommodated by recess 108 into which major margin 206 of blister pack 200 slips thus allowing raised side 219 of one or more blister units 209 to ride on the second guide surface 102 and thus be a predictable distance from blade 301. Such a tool 100 is shown in FIGS. 13 and 14.

FIG. 3 shows an additional shelf 112 which supplies a fourth guide 104 parallel to second guide 102 to hold the blister units 209 more securely to make a straighter cut by preventing the user from rocking the blister pack 200 as it is drawn through. Fourth guide 104 acts to press blister units 209 against second guide 102 to more predictably determine where the blade 301 divides the blister unit 209. Adding this fourth guide 104 also means the user can exert more force because they don't have to be so careful about guiding the blister units 209 past the blade 300.

As shown in FIG. 3, the varying depths A1-A2 of the plastic blister units 209 is accommodated by fifth guide 105 of recess 108 and sixth guide 106 of shelf 112 forming parallel rails for the major margin 206 and a major gutter 205 to ride on with the blister units 209 sunk in-between in a channel 123 bounded by first, second and fourth guides, numbered 101, 102 and 104 respectively. As the user advances a flat 200 though the tool 100, the blade 301 tends to push the blister units 209 towards the surface of the third guide 103. This means that regardless of the depth of the channel 123 between by the rails, the distance from the tip of the blade 300 to the third guide surface 103 tends to be the maximum depth of the un-cut portion of the paper/plastic backing layer 203, sealing foil layer 202, and blister layer 217 (including both the raised and un-raised, flat portions of the blister layer 217). This is meaningful because blister units 209 can be of various depths so a deep enough channel can accommodate more than one blister unit 209 depth.

Figure 10:
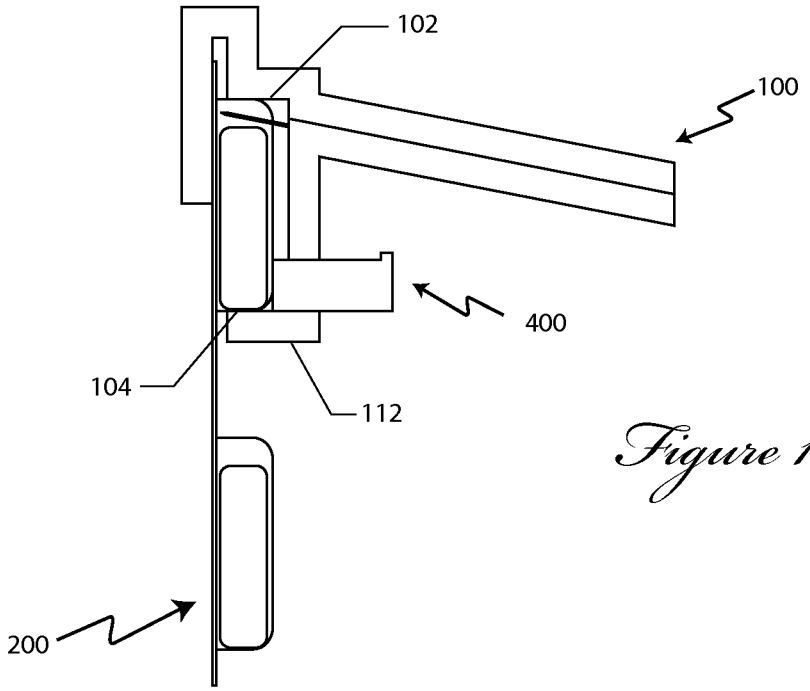
FIG. 10 is a side view of the invention depicted in FIG. 1 cutting into a blister pack at an oblique angle with the adapter component in a storage position.
Figure 11:
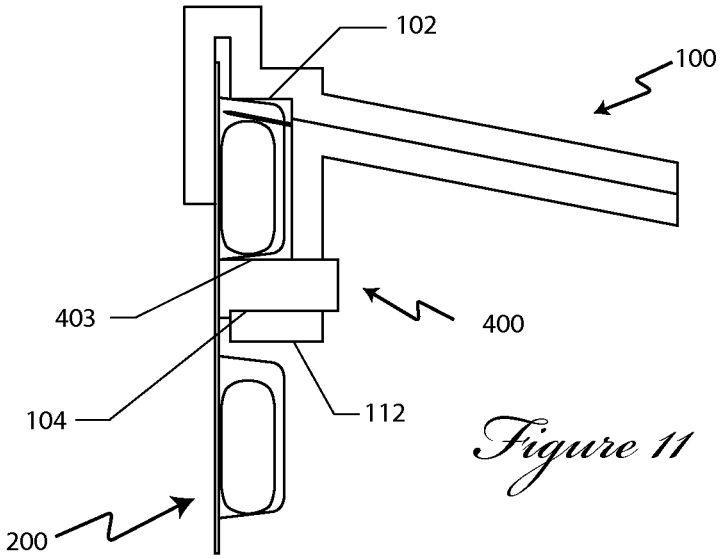
FIG. 11 is a side view of the invention depicted in FIG. 1 cutting into a blister pack at an oblique angle with the adapter component in a first position.
Figure 12A:
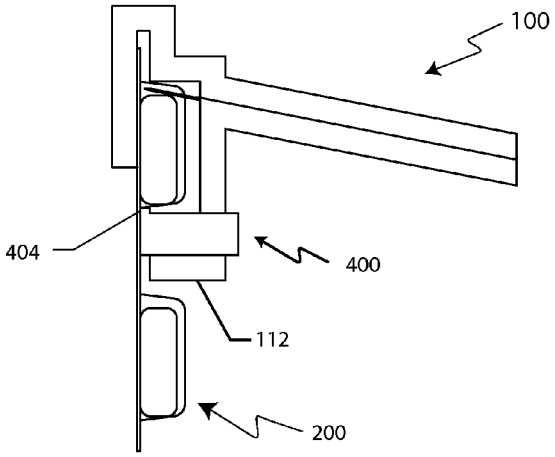
FIG. 12*a* is a side view of the invention depicted in FIG. 1 cutting into a blister pack at an oblique angle with the adapter component in a second position.
Figure 12B:
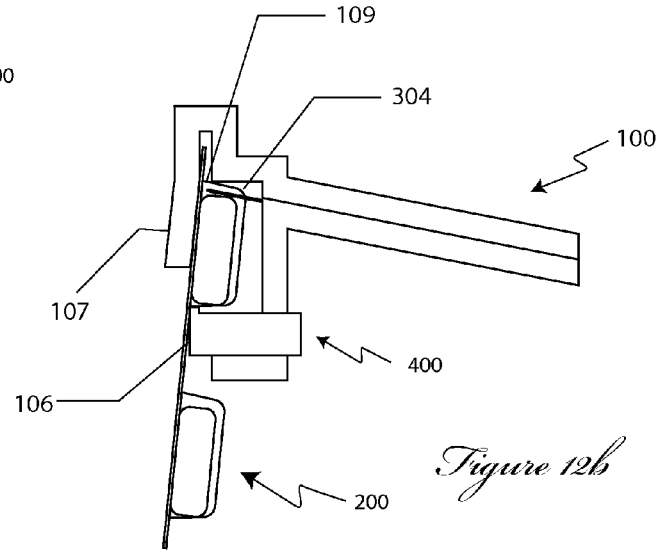
FIG. 12*b* is a side view of the invention depicted in FIG. 1 configured with an angled backwall effective for tilting a blister pack so as to allow the sharp to cut the blister pack at an orthogonal angle relative to the blister pack's base, and equipped with the adapter component in a second position.
Figure 12C:
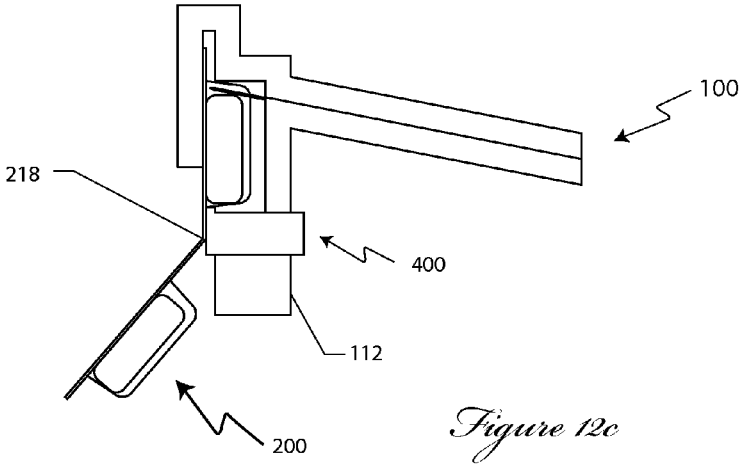
FIG. 12*c* is a side view of the invention depicted in FIG. 12*a* with the lower row on the blister pack folded relative to the upper row on the blister pack.
Figure 13:
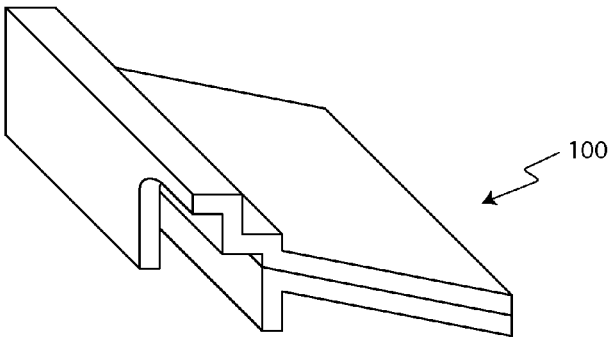
FIG. 13 is a perspective view of an alternative embodiment of the invention (i.e. sans shelf).
Figure 14:
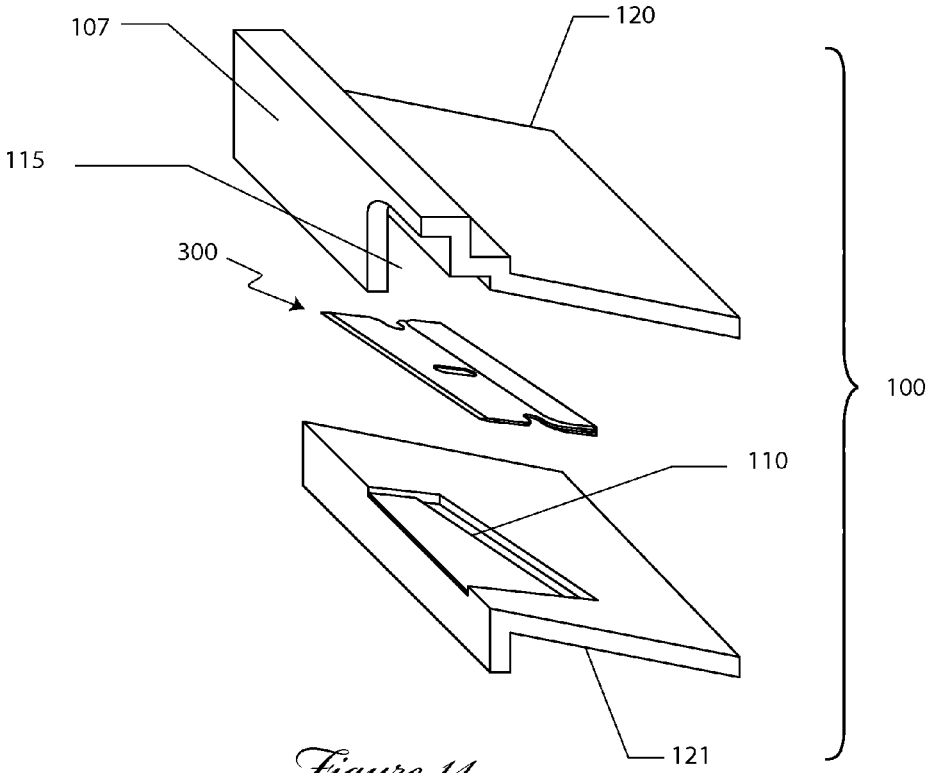
FIG. 14 is an exploded perspective view of the invention depicted in FIG. 13.

As shown in FIGS. 10, 11 and 12*a*, blister units 209 of varying widths (B1-B2 as shown in FIG. 5) can be accommodated by varying the relative distance from the fourth guide surface 104 to the second guide surface 102 (in the version of the tool 100 where there is no fourth guide 104, as shown in FIGS. 13 and 14, any width of blister unit 209 can be accommodated). The length C1-C2 of an individual blister unit 209 as shown in FIG. 5 or the length E1-E2 of a flat of blisters 200 as shown in FIG. 5 is immaterial so the blister units 209 can be various shapes such as square or rectangular and the present invention can accommodate them. As shown in FIG. 11, an adapter 400 can be utilized which removably attaches to the tool 100 and sits on the fourth guide surface 104 thus decreasing the dimension from the second guide surface 102 to the fourth guide surface 104 so that a first edge 403 of said adapter 400 effectively becomes the fourth guide 104. FIG. 2*b* shows the adapter 400 removed which reveals the twin cantilever snap hooks 401. Said snaps hooks 401 engage by sliding over the corresponding snap fit recesses 113. One or more spacers 402 provide tension to hold the adapter 400 tightly and keep its shape. Furthermore, as shown in FIG. 12*a*, said adapter 400 can be flipped to present a second edge 404 which allows yet a third distance between the second 102 and fourth guides 104. As shown in FIG. 12*b*, this adapter 400 can also be dimensioned to cause an increase in the depth of the fourth guide 104 which can change the tilt angle 304 that the blister units 209 are oriented with respect to the blade 300. FIG. 12*b* also shows how optional blade guard 107 can be shaped to allow the flat 200 to tilt while still maintaining the desired cutting depth for the uncut blister portion 109. Optionally, said adapter 400 can also be conveniently stored when snapped on from behind as shown in FIG. 10. These adaptations are meaningful because at present there are at least three different basic sizes of blister packs 200 on sale in the United States, so it is convenient that one tool 100 with one adapter 400 could accommodate them all. Alternatively, one could make multiple tools 100, each tailored to one particular size of blister pack 200 which might require less thought on the part of the user (than figuring out how to use an adapter 400). In the preferred embodiment the fourth guide 104 is fixed, but it could be adjustable relative to the second guide 102. The preferred embodiment presented where the fourth guide 104 is fixed is easier to manufacture and is only two pieces plus a blade 300 or, where the two halves 120 and 121 are joined by a living hinge 118 (shown in FIGS. 18*a* and 18*b*) or the blade 300 is molded in (not shown), is only one piece plus a blade 300. For ease of use, the shelf 112 (plus any adapter) should not be thicker than the width of the major gutter 205, but, as shown in FIG. 12*c*, if it is then the major gutter 205 usually has a perforation 218 running down its center which allows the user to easily bend the flat 200 and still make use of the tool 100.

The blister sides 219 (as shown in FIG. 6*a*) rising from the sealing foil 202 can vary to be either more perpendicular or angled, resulting in either a more rectangular cuboid shaped blister unit 209 as shown in FIG. 4 or trapezoidal cuboid shaped blister unit 209 as shown in FIG. 6*a*. As shown in FIGS. 4 and 5, gum 204 is generally a rectangular cuboid with rounded edges 207. The blister pocket is larger than the gum 204 within resulting in a void 208 between the gum 204 and the side 219 of the blister unit 209. The size of this void 208 and the radii of rounded edges 201 varies from one design of blister pack 200 to another. This becomes meaningful because the blade 301 cuts most easily by running through that void 208. If the void 208 is particularly small and/or the blister unit's 209 rounded edge 201 is of larger radii, one can most fully utilize the void 208 by slanting the blade 300 as shown in FIG. 6*a*. The larger the void 208, as shown in FIG. 4, the less advantage there is to this angling or tilting of the blade 300. As shown in FIG. 12*b*, in addition to or instead of angling the razor blade 300, one can vary the depth of the sixth guide 106 to vary the tilt angle 304. While cutting within the void 208 and not nicking the gum 204 is preferable, nicking the gum 204 while cutting the blister unit 209 may be acceptable, especially with a softer gum 204 which tends to "heal" such cuts where the divided parts of the gum 204 expose tacky surfaces which can adhere together again.

A tilt angle 304 of between about five to fifteen degrees, preferably about eleven degrees, from perpendicular provides optimal clearance for the three common sizes of blister packs 200 for nicotine gum 204. Depending on the design of the blister pack 200 one wishes to open, one can make suitable adjustments to this angle 304. Additionally, one could have the razor 300 controllably pivot to allow the user to change the tilt angle 304 (not shown).

Although this disclosure focuses on opening blister packs 200 containing nicotine gum 204, this device can be adapted to open blister packs 200 containing other items such as other kinds of gum 204 or pills or even larger items in larger blister packs 200.

Figure 7A:
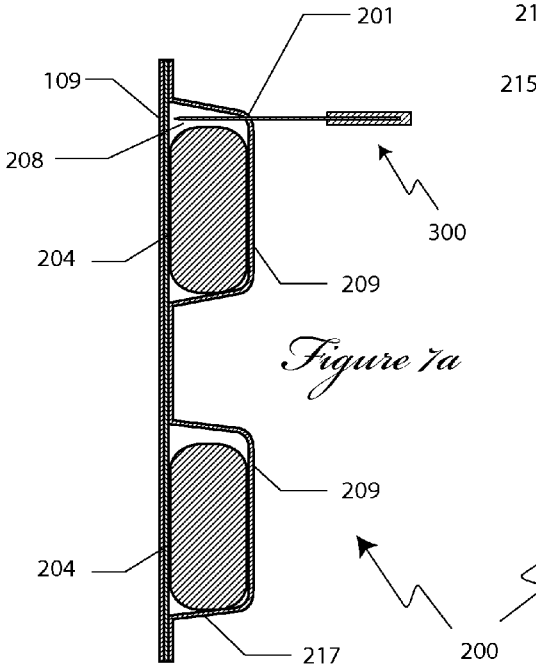
FIG. 7*a* is a side view of the sharp portion of the invention depicted in FIG. 1 cutting into a blister pack at an orthogonal angle.
Figure 7B:
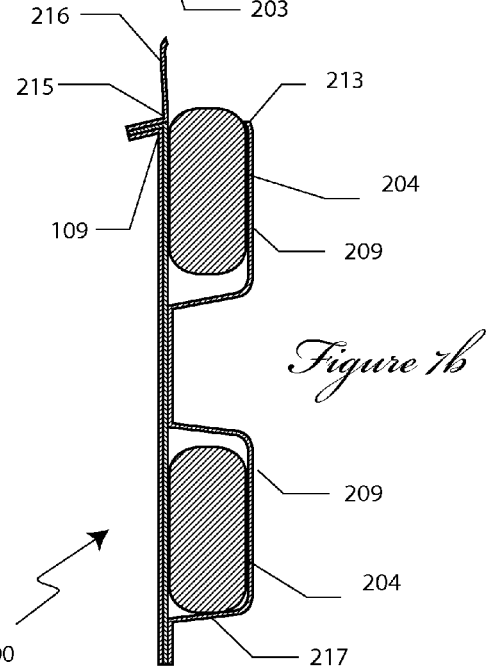
FIG. 7*b* is a side view of the blister pack depicted in FIG. 7*a* after being cut by the sharp portion of the invention with one of the blisters bent open and the product partially removed.

As shown in FIG. 3, the distance from the blade 301 to second guide 102 determines the maximum thickness of the hinged door 216. Where the blister unit 209 is of a more square shape, one can make this cut shallower (i.e., a thinner door 216) with the blade 301 more parallel to the second guide 102 (to create a more right angled rectangular door 216). As is shown in FIGS. 6*a*, 6*b*, 7*a*, and 7*b*, when the sides 219 of the blister unit 209 are more angled (making the blister units 209 more trapezoidal) or have rounded edges 201 with greater radii, it is preferable to have the blade 301 cut further from the second guide 102 surface to cut a thicker door 216 and/or to tilt the blade 301 at an angle 304 to create a more parallelogram door 216. For example, FIG. 6*a* shows blister unit 209 being cut by razor 300 with blade 301 tilt angle 304. FIG. 6*b* shows resulting door 216 which is of sufficient thickness that smooth lip 212 is created allowing the gum 204 to exit easily. As an example of a problem which can result from an inappropriate blade 301 tilt angle 304, FIG. 7*a* shows cutting blister unit 209 with blade 300 perpendicular to the sealing foil 202. FIG. 6*b* shows the result of this which is a thinner door 216 with hinge 215 which leaves hooked lip 213 which can prevent the gum 204 from exiting. The point is to create a sufficiently sized and shaped door 216 to enable the gum 204 to exit the blister unit 209 easily. As there are presently several sizes and shapes of blister units 209 in existence, as well as various shaped gums 204 and more variations may appear in the future, these directions will assist the user in creating adaptations without departing from the spirit and scope of the present invention.

As shown in FIG. 15, as the blister units 209 go through the tool 100 in the direction from D1 towards D2, cutting edge 302 of razor blade 300 cuts through some depth of blister unit 209 of the plastic blister layer 217, sealing foil 202 and paper/plastic structural backing 203 (said sealing foil 202 and structural backing 203 are drawn as one layer for simplicity). The blade's cutting edge 302 can be angled relative to the plane defined by the sealing foil 202 to form an attack angle 305. The attack angle 305 affects how the cutting edge 302 of the blade 301 cuts and determines the minimum length D1-D2 of the tool 100 (so that the sharp edge 302 of the blade 301 is not exposed so as to be a danger to the user and so the razor blade 300 is held securely). The closer this attack angle 305 is to perpendicular or ninety degrees relative to the sealing foil 202, the more the blade 301 is ramming through the plastic blister unit 209. The closer to zero degrees, the more slicing (as opposed to ramming) results. A higher attack angle 305 requires a shorter exposed cutting edge 302 and a lower attack angle 305 requires a longer cutting edge 302. As the attack angle 305 approaches zero, the cutting edge 302 approaches infinity in length, thus as the attack angle 305 decreases, length D1-D2 increases. As slicing requires less effort than ramming and tends to create a smoother cut edge of the blister unit 209, the smaller the attack angle 305 the easier and smoother the cutting motion will be in general. The longer length D1-D2 is, the less the flat 200 tends to rock as it passes through the tool 100 making for a more controlled cutting depth. Choosing this attack angle 305 can be affected by such things as the length of the chosen blade's 301 cutting edge 302, the height of the blister units 209, and the length of the pack 200 to be cut (for instance, with a longer pack 200 and a lower attack angle 305 one can wind up cutting through more of the blister unit 209 walls at one time which requires more force on the leading cutting edge 302 and produces more drag on the trailing portion of the razor blade 300) so one can be trading efficiency for cutting ease. One should also be aware that it requires more effort to cut through the leading edge of rounded portions 201 of the blister units 209 so incorporating a blade 301 attack angle 305 which hits fewer of these at a time makes for easier cutting (cutting through the flat 200 walls or the trailing rounded edges makes less difference in cutting effort expended). Also, the blade 301 might deflect or bend as it cuts each blister unit 209 thus departing from the initial tilt angle 304 (FIG. 6*a*) and then return to its initial state when the blade 301 is "free" while in the minor gutters 210 between blister units 209, which is another advantage of a relatively high attack angle 305. Also, a thinner blade 301 deflects more than a thicker blade 301, but a thicker blade 301 has more drag so another trade-off is presented. And, of course, razor blades 300 can have various coatings to reduce drag but may cost more than uncoated blades 301 or the user may not want said coating to contact the gum 204. These conflicting advantages and disadvantages can be balanced by the individual user's design choices. The preferred embodiment utilizes a commonly available, inexpensive single-edged razor blade 300 (measuring approximately 1.5" by 0.75"×0.012") which, combined with the various blister packs 200 commonly available in the United States, works well at an attack angle 305 of between ten to twenty degrees, with attack angle 305 of fifteen degrees preferred, as shown in FIG. 15, and a tilt angle 304 of between five and fifteen degrees, preferably an eleven degree tilt angle 304 as shown in FIG. 6*a*. This results in an economical, pocket-sized tool 100 which comfortably fits in the palm of one's hand. Of course the user can vary the razor's 300 tilt 304 and attack 305 angles as one wishes to meet their own demands or preferences. There are many sizes, shapes, thicknesses and types of cutting blades 301 that could be used, including curved or rotating blades 301, without departing from the spirit and scope of the present invention.

FIG. 3 shows how the razor blade 300 is contained in a recess 110 which retains part of the razor blade 300 and allows a portion of the blade 301 to protrude beyond first guide 101. The blade 301 is secure because the recess 110 is shaped to receive it, plus the cutting motion tends to press the blade back 303 into its recess 110, all of which combines to prevent the blade 301 from popping out. The exterior surface of this portion containing the blade recess 110 can provide places to grip the tool 100 while using it. The materials, dimensions and shape of this portion of the device can be varied to make is easier to grip or more portable or compact or attractive or economical without departing from the spirit and scope of the present invention.

Figure 16:
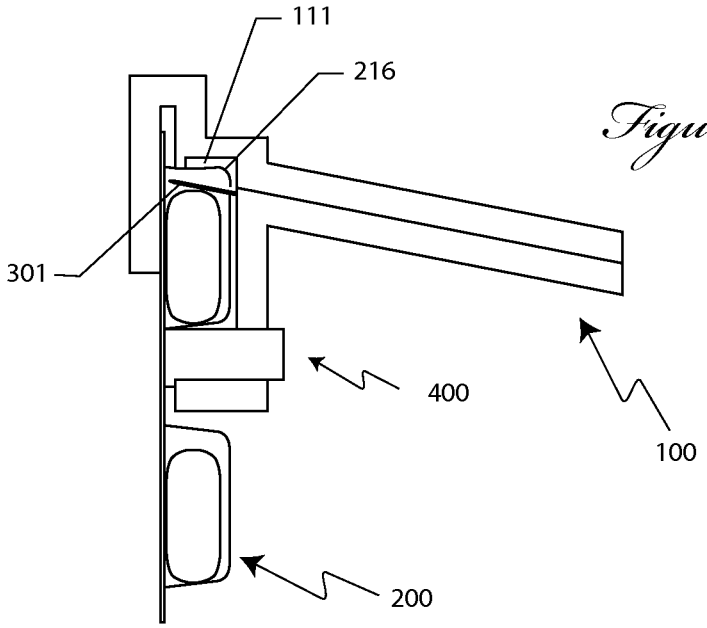
FIG. 16 is a cutaway side view of another embodiment of the invention having extra space for a cut door to expand into.

FIG. 16 shows an optional channel 111 which allows the door 216 to flex away from the blade 301 while retaining the guides mentioned elsewhere in this disclosure. This can be advantageous because while the blister unit 209 is being cut it expands by at least the thickness of said blade 301. This expansion can cause the uncut blister units 209 to be forced down which results in a thinner door 216 being cut. Channel 111 allows for this expansion and allows a more uniform division of the blister units 209.

Figure 17:
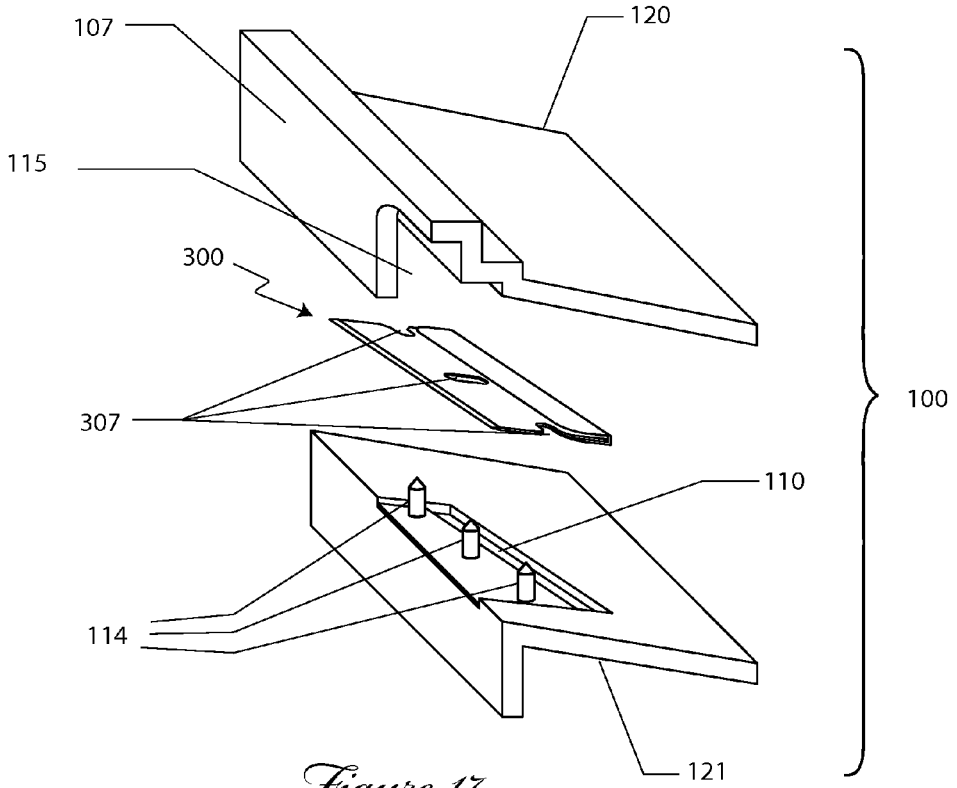
FIG. 17 is an exploded perspective view of another embodiment of the invention having registration protrusions.

As shown in FIG. 17, the recess 110 which receives the razor blade 300 can also have protrusions 114 which go through the holes/notches 307 of the blade 301. These protrusions 114 can provide a means to register the blade 301 during assembly and to secure the blade 301 in position thereafter. Optionally, they could fit into corresponding holes (not shown) in the upper half 120 to increase their rigidity. Further, these protrusions 114 can be melted or compressed which would tend to cement the blade 301 in place even more securely. For example, the protrusions 114 could go through holes/notches 307 in the blade 301 and serve as energy directors for a sonic welder. In that case the protrusions are melted and weld the blade 301 in place resulting in a very solid, exact position with virtually no "wiggle room" making the orientation of the blade 301 more predictable. They could serve to weld the blade 301 in place before joining the upper half 120 or could weld the blade 301 in place and weld the upper and lower halves 120 and 121 together in one step.

Although the razor blade 300 has been shown throughout this disclosure as fitting into a recess 110 in the lower half 121, obviously the recess 110 could be in the upper half 120 or the recess 110 could be partially in each of the halves 120 and 121.

The method of manufacture and material of the tool 100 (other than the razor blade 300 and any joining material) is preferably injection molded plastic. The tool 100 parts can be specifically designed for manufacture by this method and material (e.g., there are no undercuts). It is understood, however, that other methods and materials could be utilized without departing from the scope of this disclosure.

Although cutting multiple blister units 209 in one motion has been the focus of this disclosure, a user can also cut a single blister unit 209 with the tool 100 if they so desire.

Figure 19:
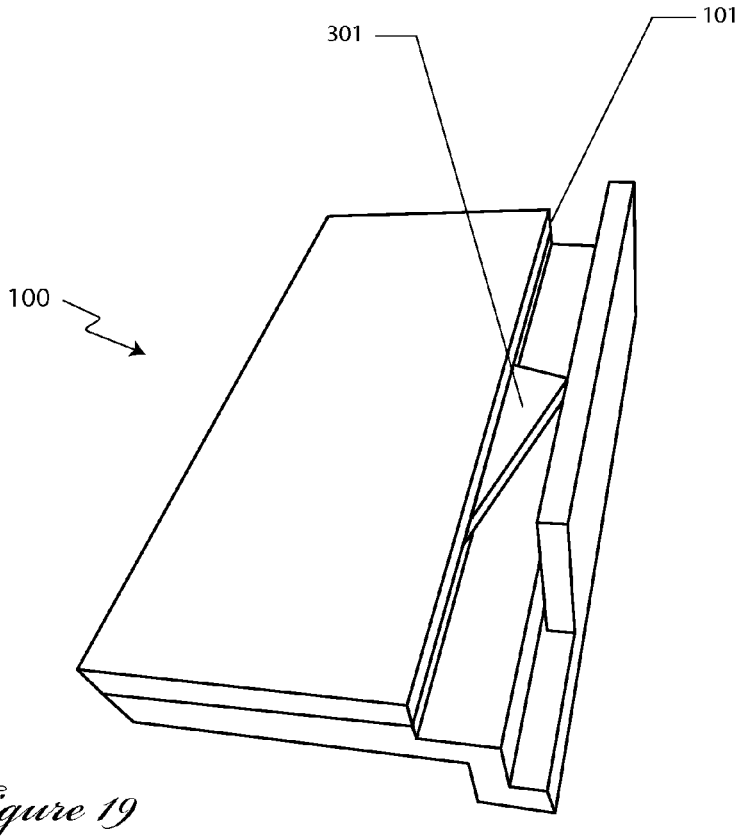
FIG. 19 is a perspective view of another embodiment of the invention having a minimal first guide.

FIG. 19 shows a version of the tool 100 where the first guide 101 has been minimized. This makes for a more compact tool 100 to carry in one's pocket.

Figure 20B:
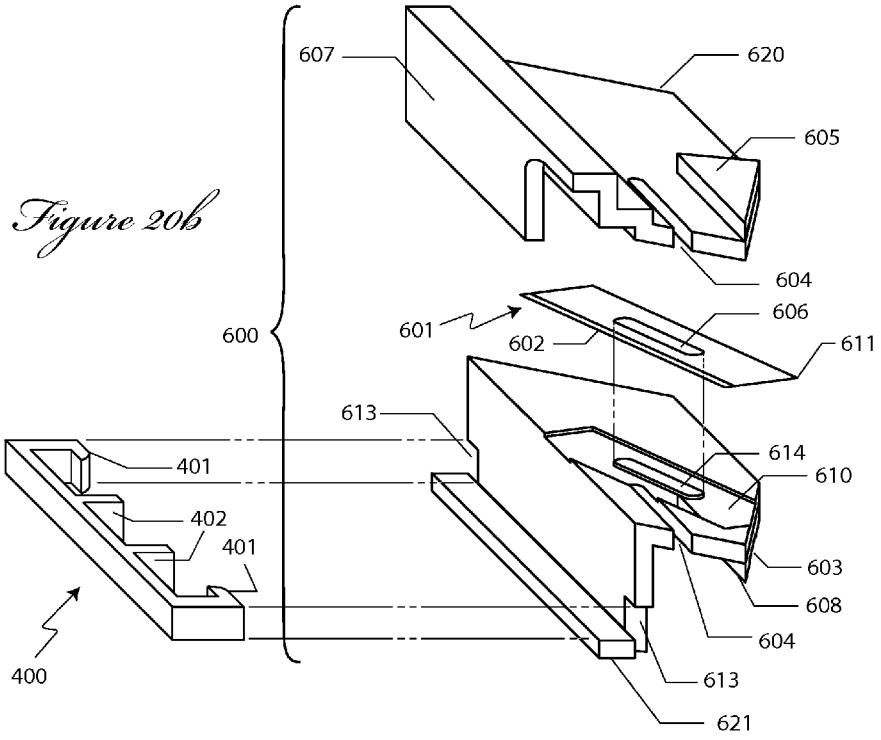
FIG. 20*b* is an exploded perspective view of the invention depicted in FIG. 20*a*.
Figure 21C:
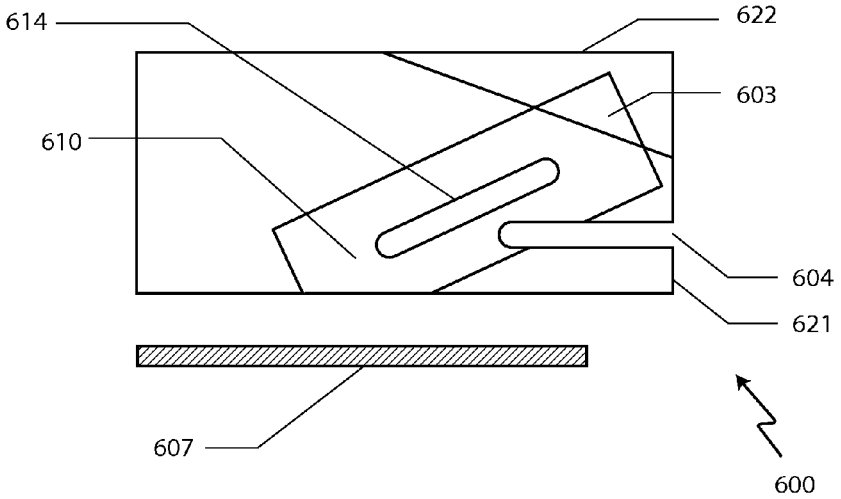
FIG. 21*c* is a top view of the invention depicted in FIG. 20*a* taken along line J1-J2 without blade and modified with a detachable cap.
Figure 21B:
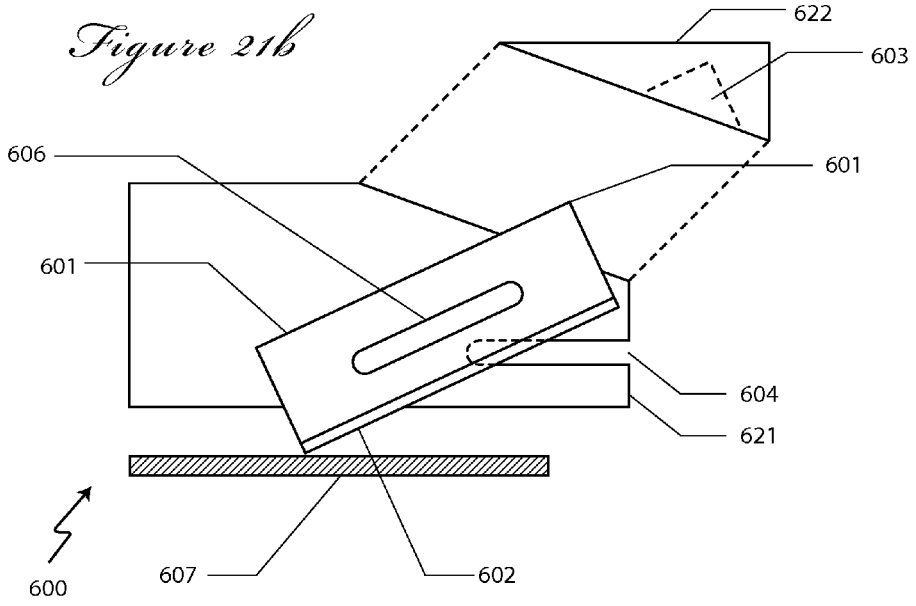
FIG. 21*b* is a top view of the invention depicted in FIG. 21*a* with detached cap.
Figure 21D:
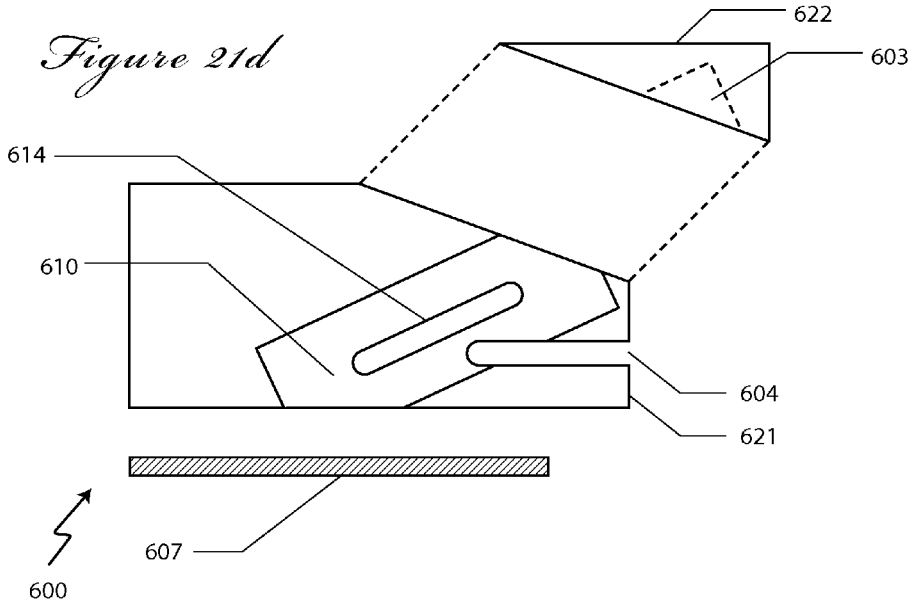
FIG. 21*d* is a top view of the invention depicted in FIG. 21*c* with detached cap.

FIGS. 20*a* and 20*b* show a multi-functional embodiment of the tool 600 with two optional additional functions. FIGS. 21*a* and 21*c* show the same variation in a cross-section of J1-J2. In FIGS. 21*a* and 21*b* blade 601 resides in recesses 610 and 603. In FIGS. 21*c* and 21*d* said blade 601 has been removed. In these drawings no means of attaching the parts together is shown, but it understood one could use a solvent, glue, welding or other known means for that purpose.

Blade 601 can be further held in place by optional protrusion 614 extending through blade hole 606. Such a protrusion can perform the functions described elsewhere for protrusions 114 (shown in FIG. 17). While recesses 610 and 603 and protrusion 614 are shown as one example of a way to retain blade 601, there are many other well known ways to retain a blade, provide interlocking parts, facilitate welding, registration and other known criteria which can selectively be used without departing from the scope of the present invention.

Slot 604 in bottom half 621 and top half 620 exposes portion 609 of the edge 602 of blade 601. The user can slide an object, such as a bag or string, into the slot 604 for cutting on the exposed portion 609 of edge 602 while being protected from getting cut when tool 600 is assembled.

Further, corner 611 of blade 601 can be exposed by swinging back hinged caps 605 and 608 as shown in FIGS. 20*a* and 20*b* or by removing detachable cap 622 as shown in FIGS. 21*b* and 21*d*. If the blade 601 is double edged, corner 611 can be useful for cutting in a way similar to a regular razor knife. For safety, blade 601 can be a single-edged blade and then corner 611 will not have a sharpened edge exposed. Such a non-sharp edge can still be useful cutting through things such as the sealing tape which holds boxes closed. Bottom cap 608 is shown having a recess 603 where blade corner 611 can rest so caps 605 and 608 can meet. Said caps 605 and 608 could have a means for holding them closed such as a interlocking snap (not shown). These hinged caps 605 and 608 are intended simply as an example, as many means of covering exposed cutters are well known such as a removable cap 622 as shown in FIGS. 21*a-d*. Such other means could be used without departing from the scope of the present invention.

FIG. 20*b* also shows adapter 400 removed which reveals the twin cantilever snap hooks 401. Said snaps hooks 401 engage by sliding over the corresponding snap fit recesses 613. One or more spacers 402 provide tension to hold the adapter 400 tightly and keep its shape.

Use

The device of the present disclosure enables the user to alter a blister pack in such a way that the blister pack itself becomes a portable, stand-alone, reclosable dispenser. By cutting through the raised blisters in a plane generally perpendicular to but not completely through the flat sealing layer(s), hinged doors are created which can be opened and closed immediately or at any future time. Thus one can process a blister pack and create doors which are initially shut. One can then put the blister pack in their pocket and leave the device of the present disclosure behind. Whenever one wishes, one can take out the transformed blister pack, easily open one or more doors and dispense the contents of those blisters, leaving the other blisters undisturbed.

Little attention is required open a transformed blister and dispense its contents, meaning one can do so safely even while walking or driving. In public, such as in a meeting or on a date, this would draw less attention to oneself. It means the simple desire to have a piece of gum (or whatever the contents of a given blister pack) can be fulfilled in a fun, easy way without the frustration, embarrassment or distraction experienced in the past.

One can also make use of an empty blister to replace the contents. This is especially handy when needing somewhere to put used chewing gum. It is also handy if one changes their mind and wants to put the unused contents back. The door can be reclosed and the pack put back in one's pocket. Thus the blister pack, in addition to becoming a stand-alone dispenser, can act as a reusable depository.

The device of the present disclosure enables the user to process a blister pack in a predictable, controlled way which requires little strength or dexterity.

Optionally, the device can be designed so the depth of the cut can be varied. This can be useful, for instance, to completely cut off the "door" enabling the user to quickly empty the blisters.

Additional useful, optional functions, such as a slitter and box opener, are also disclosed utilizing the same blade and general package, thus giving increased utility at little or no extra cost. These functions are described elsewhere in this disclosure.

I claim:

1. A manually operable tool for opening blisters on a blister pack, comprising:

(a) a body having first and second surfaces and first and second side walls and defining a laterally extending guideway, the guideway having (i) a rectangular cross-section with a rectangular cut-out in one corner resulting from a first surface of a stepped configuration forming a b-shaped cross-section, (ii) a lateral length with first and second open lateral ends, (iii) a longitudinal height defined by the first and second surfaces, and (iv) a transverse width defined by the first and second sidewalls with the first sidewall spaced in a first transverse direction from the second sidewall, wherein the stepped configuration of the first surface delineates a wide primary channel of the guideway and a narrow secondary channel of the guideway extending along the second sidewall at the intersection of the first surface and the second sidewall, (b) a slot extending the full lateral length of the guideway proximate the intersection of the second surface and the second sidewall, (c) a hand graspable tab attached to the body and extending in the first transverse direction away from the guideway, and (d) a sharp secured to the body and having a laterally extending and laterally canted cutting edge extending transversely into the primary channel of the guideway from the first sidewall a transverse distance insufficient to contact the second sidewall so as to leave a transverse gap between the sharp and the second sidewall.

2. The tool of claim 1 wherein the cutting edge is positioned proximate the first surface.

3. The tool of claim 1 wherein (i) the primary channel of the guideway is configured and arranged to accommodate and guide insertion and sliding of a row of blisters on a blister pack along the lateral length of the primary channel from the first end of the guideway towards the second end of the guideway and into cutting engagement with and past the cutting edge of the sharp, whereby the cutting edge is operable for cutting through blisters slid past the cutting edge proximate an end of each blister without cutting completely through the blister pack, and (ii) the secondary channel of the guideway is configured and arranged to accommodate insertion and sliding of a low profile margin extending from a row of blisters inserted into and slid along the primary channel.

4. A method of opening blisters on a blister pack, comprising the steps of:

(a) obtaining a tool according to claim 1, (b) obtaining a blister pack having at least one row of blisters with content and low profile margins extending alongside opposed sides of the row of blisters, (c) aligning the blister pack with the guideway at the first end of the guideway, with the row of blisters laterally aligned with the primary channel, one of the margins laterally aligned with the secondary channel, and the other margin laterally aligned with the slot, and (d) laterally sliding the aligned blister pack through the guideway and out through the second end, whereby the cutting edge cuts through an end of the blisters slid past the cutting edge without cutting completely through the blister pack so as to form a live hinge on the blister pack which is operable for providing access to the contents of the cut blister when actuated.

5. A method of opening blisters on a blister pack, comprising the steps of:

(a) obtaining a tool according to claim 2, (b) obtaining a blister pack having at least one row of blisters with content and low profile margins extending alongside opposed sides of the row of blisters, (c) aligning the blister pack with the guideway at the first end of the guideway, with the row of blisters laterally aligned with the primary channel, one of the margins laterally aligned with the secondary channel, and the other margin laterally aligned with the slot, and (d) laterally sliding the aligned blister pack through the guideway and out through the second end, whereby the cutting edge cuts through an end of the blisters slid past the cutting edge without cutting completely through the blister pack so as to form a live hinge on the blister pack which is operable for providing access to the contents of the cut blister when actuated.

6. The method of claim 5 wherein the tool is oriented with the first surface vertically above the second surface during step (d) whereby the content in each blister drops within the blister towards the second surface and away from the cutting edge.

7. A method of opening blisters on a blister pack, comprising the steps of:

(a) obtaining a tool according to claim 3, (b) obtaining a blister pack having at least one row of blisters with content and low profile margins extending alongside opposed sides of the row of blisters, (c) aligning the blister pack with the guideway at the first end of the guideway, with the row of blisters laterally aligned with the primary channel, one of the margins laterally aligned with the secondary channel, and the other margin laterally aligned with the slot, and (d) laterally sliding the aligned blister pack through the guideway and out through the second end, whereby the cutting edge cuts through an end of the blisters slid past the cutting edge without cutting completely through the blister pack so as to form a live hinge on the blister pack which is operable for providing access to the contents of the cut blister when actuated.

* * * * *